US012312044B1

(12) United States Patent
Messick et al.

(10) Patent No.: US 12,312,044 B1
(45) Date of Patent: May 27, 2025

(54) SYSTEMS AND METHODS FOR CONTROLLING CONVERTIBLE BIMINI TOPS FOR MARINE VESSELS

(71) Applicant: Brunswick Corporation, Mettawa, IL (US)

(72) Inventors: Blake M. Messick, Rockledge, FL (US); Kevin T. Farrell, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 539 days.

(21) Appl. No.: 17/711,224

(22) Filed: Apr. 1, 2022

(51) Int. Cl.
*B63B 17/02* (2006.01)
*B63B 43/18* (2006.01)

(52) U.S. Cl.
CPC ..... *B63B 17/02* (2013.01); *B63B 43/18* (2013.01); *B63B 2017/026* (2013.01)

(58) Field of Classification Search
CPC ... B63B 17/00; B63B 17/02; B63B 2017/026; B63B 43/00; B63B 43/18; B63B 3/00; B63B 3/48
USPC ..... 114/361
See application file for complete search history.

(56) References Cited

U.S. PATENT DOCUMENTS 6,152,156 A 11/2000 Tung
6,273,771 B1 8/2001 Buckley et al.
7,438,015 B1 * 10/2008 Schwindaman ..... B63B 17/02 114/361
7,798,089 B2 9/2010 McKeand
8,495,967 B2 7/2013 Williams et al.
8,522,709 B2 9/2013 Williams et al.
9,027,500 B2 5/2015 Williams et al.
9,061,748 B2 6/2015 Metcalf
9,114,854 B2 8/2015 Williams et al.
9,114,855 B2 8/2015 Nemeth
9,139,259 B2 9/2015 Williams et al.
9,302,742 B2 4/2016 Williams et al.
9,434,451 B1 9/2016 Ostmeyer et al.
9,926,045 B1 3/2018 Ostmeyer et al.
(Continued)

FOREIGN PATENT DOCUMENTS

DE 19951619 4/2011

OTHER PUBLICATIONS

Extended European Search Report issued in European Patent Application No. 22153141.1, dated Jul. 1, 2022.

*Primary Examiner* — Lars A Olson
(74) *Attorney, Agent, or Firm* — Andrus Intellectual Property Law, LLP

(57) ABSTRACT

Convertible bimini top systems are for a marine vessel having a deck and being situated in a body of water. The systems have a bimini top having a cover configured to extend over the deck, an actuator configured to raise and lower the cover relative to the deck, a controller communicatively coupled to the actuator, the controller being configured to operate the actuator to raise and lower the cover relative to the deck, and a sensor communicatively coupled to the controller, the sensor being configured to sense an obstruction proximate to the marine vessel. The controller is configured to automatically operate the actuator to lower the cover when the sensor senses the obstruction proximate to the marine vessel. Methods are for controlling the convertible bimini top to lower the cover relative to the deck based on the existence of the obstruction.

21 Claims, 16 Drawing Sheets

(56) References Cited

U.S. PATENT DOCUMENTS

| | | | |
|---|---|---|---|
| 10,118,671 | B2 * | 11/2018 | Gharabegian ..... B63B 17/02 |
| 10,198,005 | B2 | 2/2019 | Arbuckle et al. |
| 10,207,778 | B1 | 2/2019 | Bohanan et al. |
| 10,286,982 | B2 | 5/2019 | Sheedy et al. |
| 10,562,595 | B2 | 2/2020 | Williams et al. |
| 10,597,119 | B1 | 3/2020 | Lambert et al. |
| 10,800,493 | B2 | 10/2020 | Sheedy et al. |
| 10,820,672 | B2 | 11/2020 | Gharabegian |
| 10,858,072 | B1 | 12/2020 | Riordan et al. |
| 11,345,444 | B2 | 5/2022 | Mills |
| 2013/0104793 | A1 | 5/2013 | Pierce et al. |
| 2014/0041555 | A1 | 2/2014 | Ramberg |
| 2017/0323154 | A1 | 11/2017 | Kollmann et al. |
| 2018/0186433 | A1 | 7/2018 | Gharabegian |
| 2019/0375484 | A1 | 12/2019 | Wilson et al. |
| 2020/0247158 | A1 | 8/2020 | Daniels et al. |
| 2020/0407020 | A1 | 12/2020 | Riordan et al. |

* cited by examiner

SYSTEMS AND METHODS FOR CONTROLLING CONVERTIBLE BIMINI TOPS FOR MARINE VESSELS

FIELD

The present disclosure relates to marine vessels and particularly to convertible bimini tops for marine vessels.

BACKGROUND

The following U.S. Patents and Publications are incorporated herein by reference:

U.S. Pat. No. 10,198,005 discloses a method for controlling movement of a marine vessel including controlling a propulsion device to automatically maneuver the vessel along a track including a series of waypoints, and determining whether the next waypoint is a stopover waypoint at or near which the vessel is to electronically anchor. If the next waypoint is the stopover waypoint, a control module calculates a distance between the vessel and the stopover waypoint. In response to the calculated distance being less than or equal to a threshold distance, the propulsion device's thrust is decreased. In response to sensing that the vessel thereafter slows to a first threshold speed, the vessel's speed is further reduced. In response to sensing that the vessel thereafter slows to a second, lower threshold speed or passes the stopover waypoint, the propulsion device is controlled to maintain the vessel at an anchor point which is at or near the stopover waypoint.

U.S. Pat. No. 9,434,451 discloses a foldable watersports tower which is mountable on a boat and configured to serve as both a watersports tower and to provide support for a sun cover. The tower includes a cover frame and a leg supporting the cover frame. The leg includes a first leg section having a lower end and an upper end. The lower end of the first leg section is pivotally mountable adjacent the boat at a first lower pivot location, and the upper end of the first leg section is pivotally connected to the cover frame at a first upper pivot location. The leg includes a second leg section having a lower end and an upper end. The lower end of the second leg section is pivotally mountable adjacent the boat at a second lower pivot location. The upper end of the second leg section is pivotally connected to the cover frame at a second upper pivot location. The tower is foldable so as to be raisable and lowerable between a raised position and a lowered position and the cover frame is capable of remaining in a constant attitude as the tower travels between the raised position and the lowered position.

U.S. Pat. No. 9,139,259 discloses a folding bimini top having a vertical arch member which may be pivotally raised and lowered or released relative to a boat hull, and a lateral support member which can receive a sun cover or cargo, and which has a first portion pivotally connected to the arch member and a second portion which releasably connects to the arch member via a latch.

U.S. Pat. No. 9,114,855 discloses a folding arch system for a boat which includes an arch member pivotally connected to a boat hull and pivotally position-able relative to the boat hull between a raised position and a lowered position. A lateral support is pivotally connected to the vertical arch. A rigid canopy is pivotally connected to the arch member and yield-ably coupled to the lateral support. The vertical arch member and the lateral support supportably position the rigid canopy in a predetermined horizontal orientation.

U.S. Pat. No. 6,273,771 discloses a control system for a marine vessel, which incorporates a marine propulsion system which can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Patent Publication No. 2020/0247518 discloses a marine propulsion system including at least one propulsion device and a user input device configured to facilitate input for engaging automatic propulsion control functionality with respect to a docking surface, wherein the user input device includes a direction indicator display configured to visually indicate a direction with respect to the marine vessel. A controller is configured to identify a potential docking surface, determine a direction of the potential docking surface with respect to the marine vessel, and control the direction indicator display to indicate the direction of the potential docking surface with respect to the marine vessel. When a user selection is received via the user input device to select the potential docking surface as a selected docking surface, and propulsion of the marine vessel is automatically controlled by controlling the at least one propulsion device to move the marine vessel with respect to the selected docking surface.

U.S. Patent Publication No. 2017/0323154 discloses an object detection system for a marine vessel having at least one marine drive including at least one image sensor positioned on the marine vessel and configured to capture an image of a marine environment on or around the marine vessel, and a processor. The object detection system further includes an image scanning module executable on the processor which receives the image as input. The image scanning module includes an artificial neural network trained to detect patterns within the image of the marine environment associated with one or more predefined objects, and to output detection information regarding a presence or absence of the one or more predefined objects within the image of the marine environment.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

The present disclosure provides convertible bimini top systems for a marine vessel having a deck and being situated in a body of water. By way of example, the convertible bimini top system comprises a bimini top having a cover configured to extend over the deck, an actuator configured to raise and lower the cover relative to the deck, a controller communicatively coupled to the actuator, the controller being configured to operate the actuator to raise and lower the cover relative to the deck, and a sensor communicatively coupled to the controller, the sensor being configured to sense an obstruction proximate to the marine vessel. The controller advantageously is configured to automatically operate the actuator to lower the cover when the sensor senses the obstruction proximate to the marine vessel.

In non-limiting examples, the sensor is configured to generate dataset representative of a geographical terrain proximate to the marine vessel, the obstruction being part of the dataset.

In non-limiting examples, the controller is configured to delineate a zone of travel for the marine vessel within the dataset, and to determine whether the obstruction is in the zone of travel. The controller is configured to automatically operate the actuator to lower the cover only when the obstruction is determined to be in the zone of travel.

In non-limiting examples, an inclinometer is communicatively connected to the controller, the inclinometer being configured to determine an angle of inclination of the marine vessel, wherein the controller is configured to calculate a virtual waterline of the body of water based on the angle of inclination. The controller can be configured to set a lower threshold of a height range of the zone of travel at the virtual waterline.

In non-limiting examples, a heading detector is configured to determine a heading of the marine vessel and the controller is configured to set a lateral mid-point of a width range of the zone of travel on the heading of the marine vessel.

In non-limiting examples, a global positioning system (GPS) receiver is configured to determine a current direction of travel of the marine vessel, wherein the controller is configured to adjust the lateral mid-point based upon a difference between the heading and the current direction of travel.

In non-limiting examples, the controller is configured to automatically operate the actuator to lower the cover when the sensor senses the obstruction proximate to the marine vessel, but only based on a comparison of the current speed to the speed threshold.

In non-limiting examples, the controller is configured to automatically operate the actuator to lower the cover based on a current global position. The controller comprises a memory which stores a waypoint associated with the obstruction, and the controller is configured to automatically operate the actuator to lower the cover based on a comparison of the current global position to the waypoint.

Corresponding methods of controlling a convertible bimini top for example comprise operating a sensor to identify an existence of an obstruction proximate to the marine vessel, and automatically operating an actuator to lower the cover relative to the deck based on the existence of the obstruction.

The methods can further comprise operating the sensor to generate a dataset representative of geographical terrain proximate to the marine vessel, delineating a zone of travel for the marine vessel within the dataset, and automatically operating the actuator to lower the cover only when the obstruction is determined to be within the zone of travel.

The methods can further comprise determining that the obstruction is within the zone of travel when the obstruction is in the height range and in the width range.

The methods can further comprise determining a virtual waterline for the body of water and adjusting a location of the height range in the dataset based on the virtual waterline.

The methods can further comprise adjusting a location of the width range in the dataset based on a heading of the marine vessel and a current direction of travel of the marine vessel.

The methods can further comprise determining a current global position of the marine vessel and automatically operating the actuator to lower bimini top based on a comparison of the current global position to a stored waypoint associated with the obstruction.

The methods can further comprise automatically operating the actuator to raise the bimini top based on an absence of the obstruction.

Each of the non-limiting examples summarized herein above are combinable with each other in the manner suggested below, as well as in any other combination thereof, as would be possible and understood by one having ordinary skill in the art based upon the following description of preferred embodiments.

BRIEF DESCRIPTION OF THE DRAWINGS

The present disclosure includes the following Figures.

Figure 1:
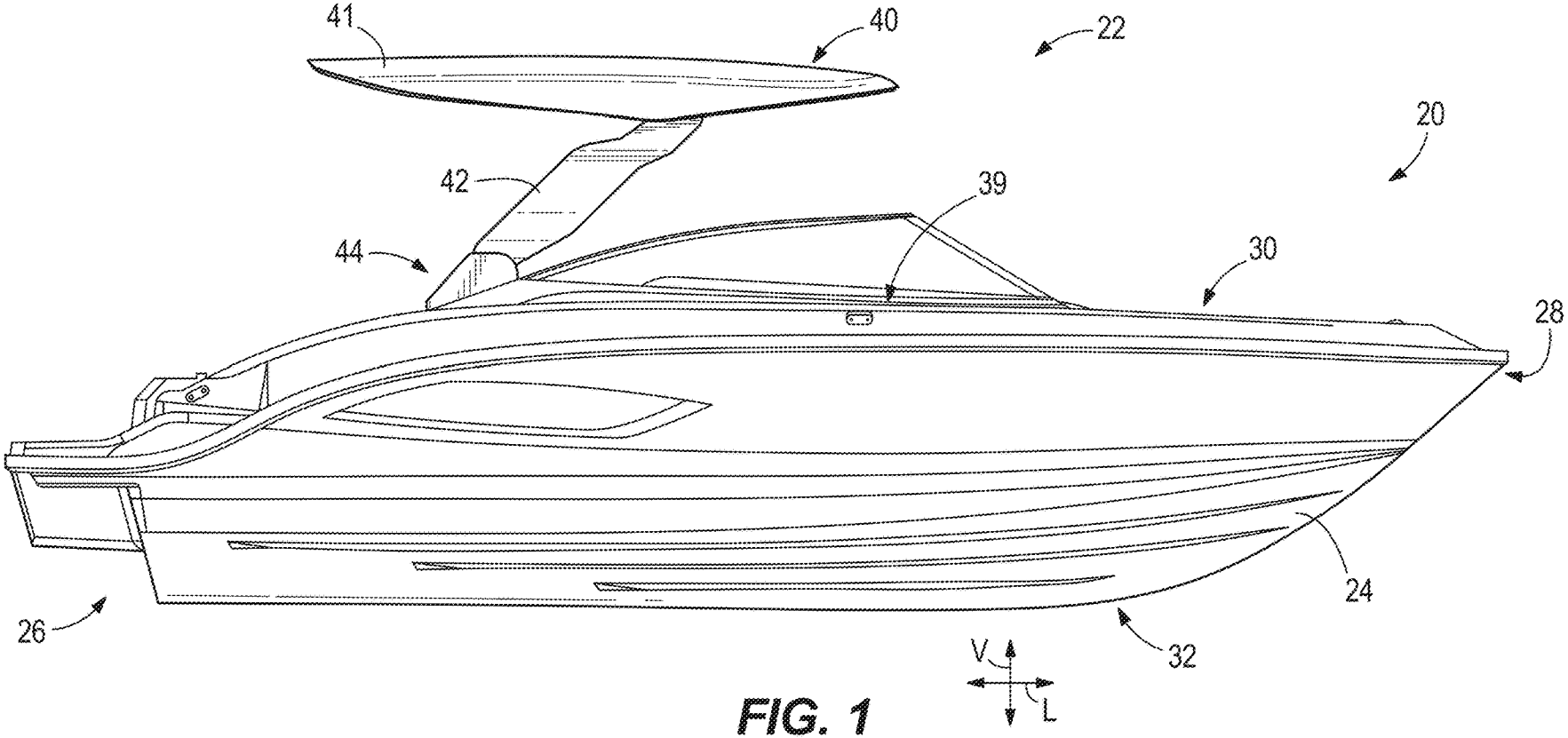
FIG. 1 is a starboard side view of an example marine vessel having an example convertible bimini top according, showing the bimini top in a raised position.
Figure 2:
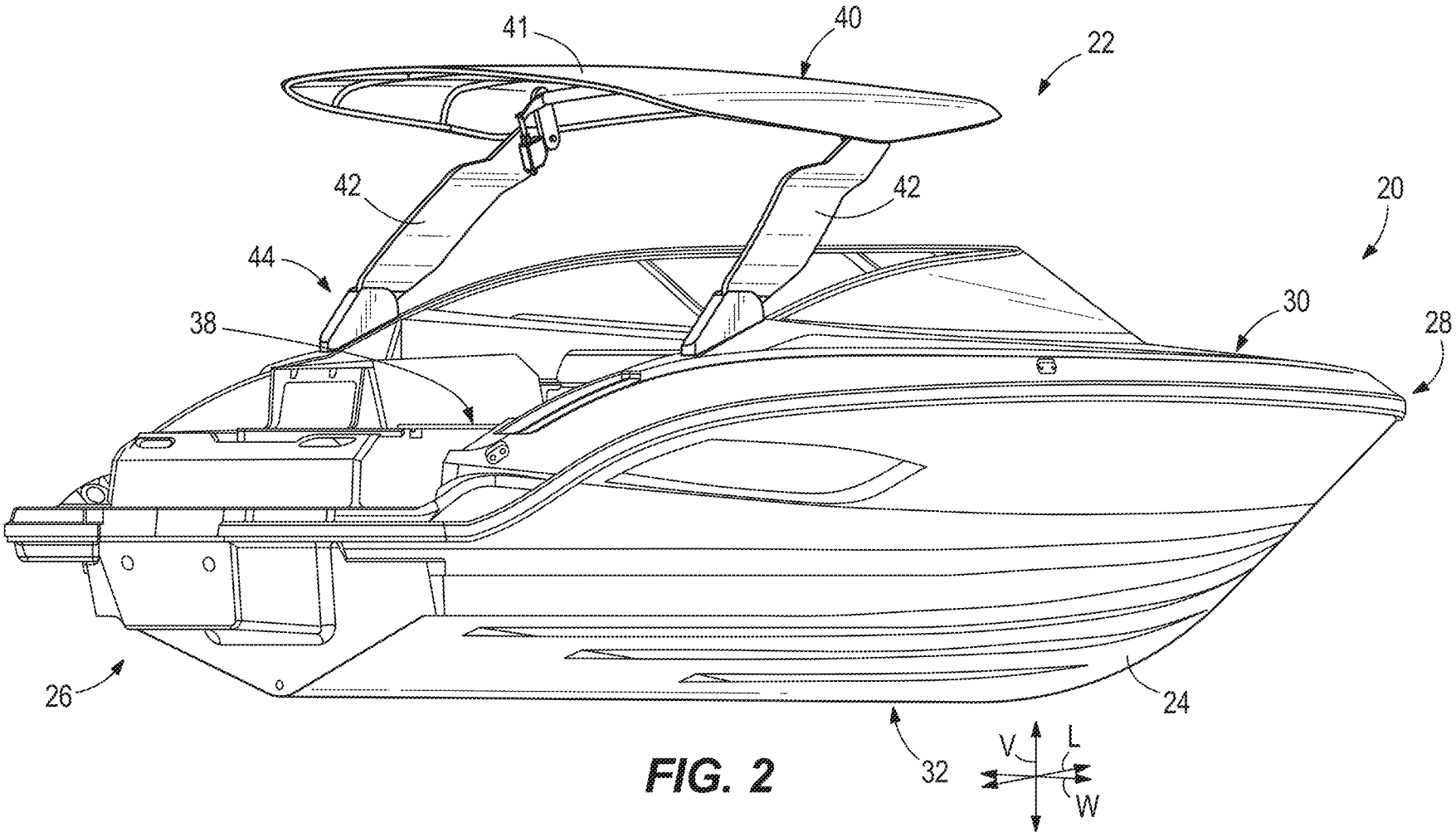
FIG. 2 is a rear, starboard side view of the marine vessel showing the bimini top in the raised position.
Figure 3:
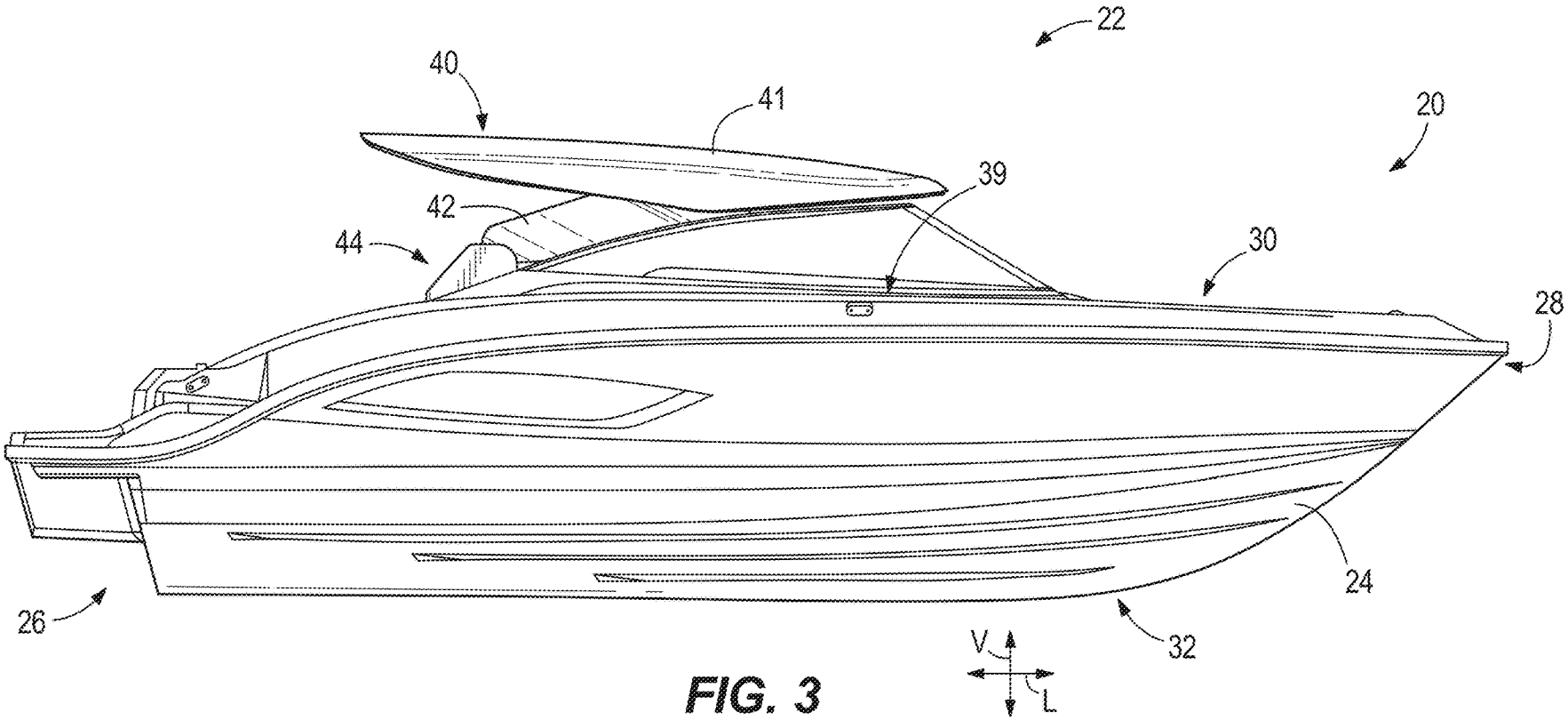
FIG. 3 is a starboard side view of the marine vessel showing the bimini top in a lowered position.
Figure 4:
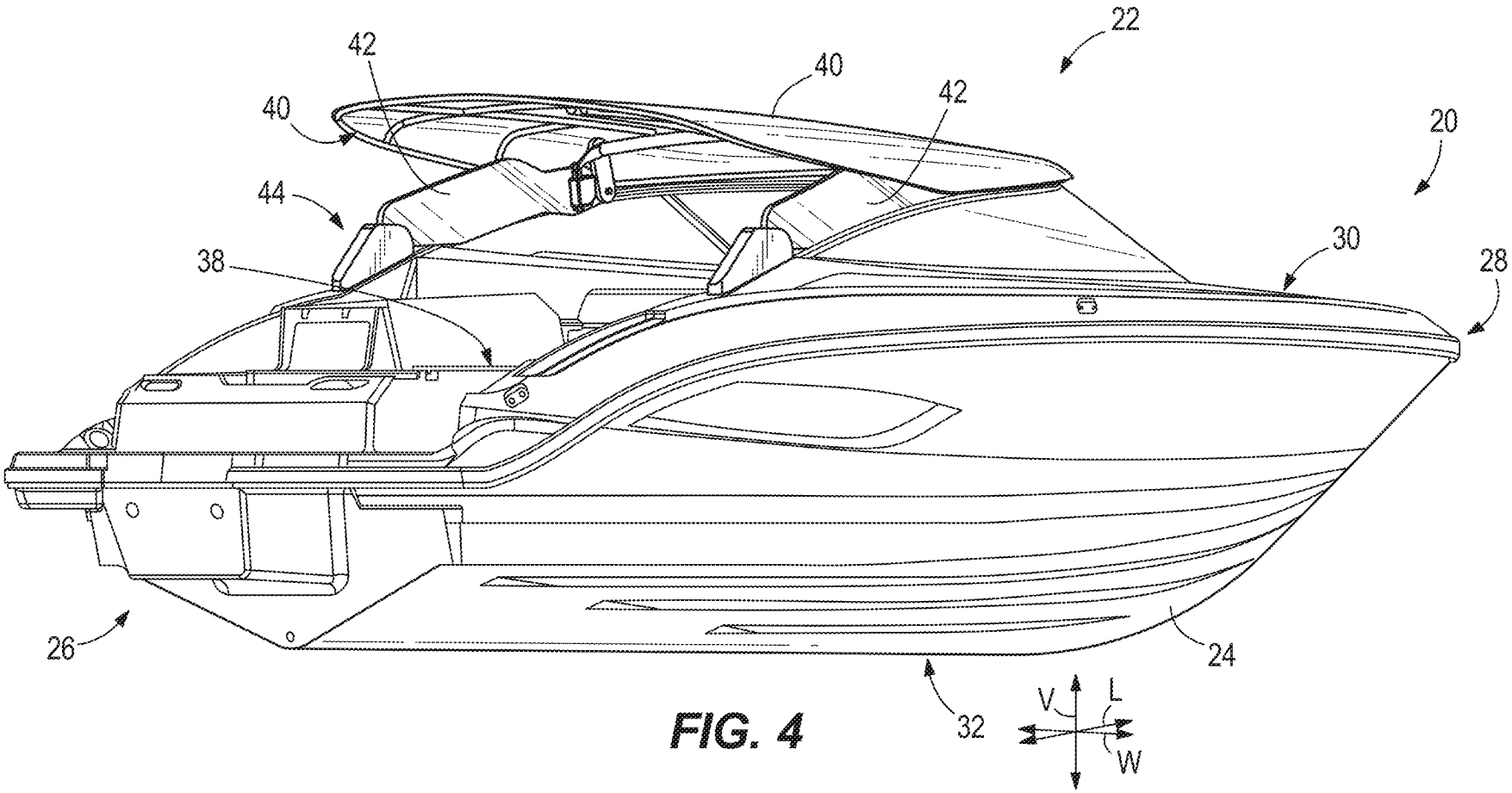
FIG. 4 is a rear, starboard side view of the marine vessel showing the bimini top in the lowered position.

Claim 14 is a schematic depicting the system sensing an obstruction when the marine vessel is traveling in a direction that is different than the heading of the marine vessel.

FIGS. 15-19 are flow charts illustrating several methods according to the present disclosure.

DETAILED DESCRIPTION

During research and experimentation in the field of marine technology, and particularly regarding bimini top apparatuses for marine vessels, the present inventors have realized a desirability of providing improved bimini top apparatuses which are controllable to move into a variety of positions relative to the marine vessel. The present inventors have also realized a desirability of providing such improved bimini top apparatuses which are controllable in a way that maintains the cover of the bimini top in a substantially horizontal orientation as it is moved up and down relative to the marine vessel. The present inventors have also realized a desirability of providing such improved bimini top apparatuses which are controllable in a way that permits tilting or pivoting of the cover relative to the support arms for the cover frame and relative to the hull of the marine vessel.

Prior art bimini top apparatuses, such as disclosed in the above-incorporated U.S. Pat. No. 9,434,451, often have one or more actuators for raising and lowering the cover frame relative to the marine vessel. These actuator(s) are conventionally connected to the lower portion of the support arms of the bimini top, proximate to the hull of the marine vessel. In some embodiments, the prior art actuators are connected to the support arms via a mechanical linkage which is configured so that pivoting movement of the lower portions of the port and starboard support arms causes a corresponding pivoting movement of the cover frame. During research and experimentation, the present inventors have found that such prior art mechanical linkages are unsightly. Thus, the present inventors realized it would be desirable to provide improved bimini top apparatuses which are more streamlined than the prior art, by omitting the noted mechanical linkage but still retaining the ability to actively control the orientation of the cover frame, for example to maintain a horizontal orientation of the cover frame and/or to provide rain and/or sun cover. The present disclosure is a result of the above-described efforts.

FIGS. 1-4 illustrate a marine vessel 20 having a bimini top 22 configured according to the present disclosure. The marine vessel 20 has hull 24 which generally extends from stern 26 to bow 28 in a longitudinal direction L, from top 30 to bottom 32 in a vertical direction V which is transverse to the longitudinal direction L, and from port 34 to starboard 36 in a width direction W which is transverse to the longitudinal direction L and transverse to the vertical direction V. As conventional, the marine vessel 20 has a deck or floor, which is not shown but is generally located in the direction of arrow 38, and which generally extends in the longitudinal direction L and in the width direction W. As conventional, the marine vessel 20 has a helm 39 with various operator input devices, such as for example a key switch, steering wheel, throttle, a shift lever and/or the like via which an operator of the marine vessel 20 can control movement of the marine vessel 20 in the surrounding body of water.

The bimini top 22 has a cover frame 40 which extends generally over the top of the middle of the marine vessel 20, including over the helm 39. A cover 41 such as a flexible sheet or other covering element is attached to and supported by the cover frame 40. The configuration of the cover frame 40 and cover 41 can vary from what is shown. In the illustrated embodiment, the cover frame 40 and cover 41 have a streamlined, elongated foil-shape which is aerodynamic. Port and starboard support arms 42 support the cover frame 40 above the marine vessel 20. The support arms 42 are pivotable relative to the marine vessel 20, as will be further described below.

Figure 5:
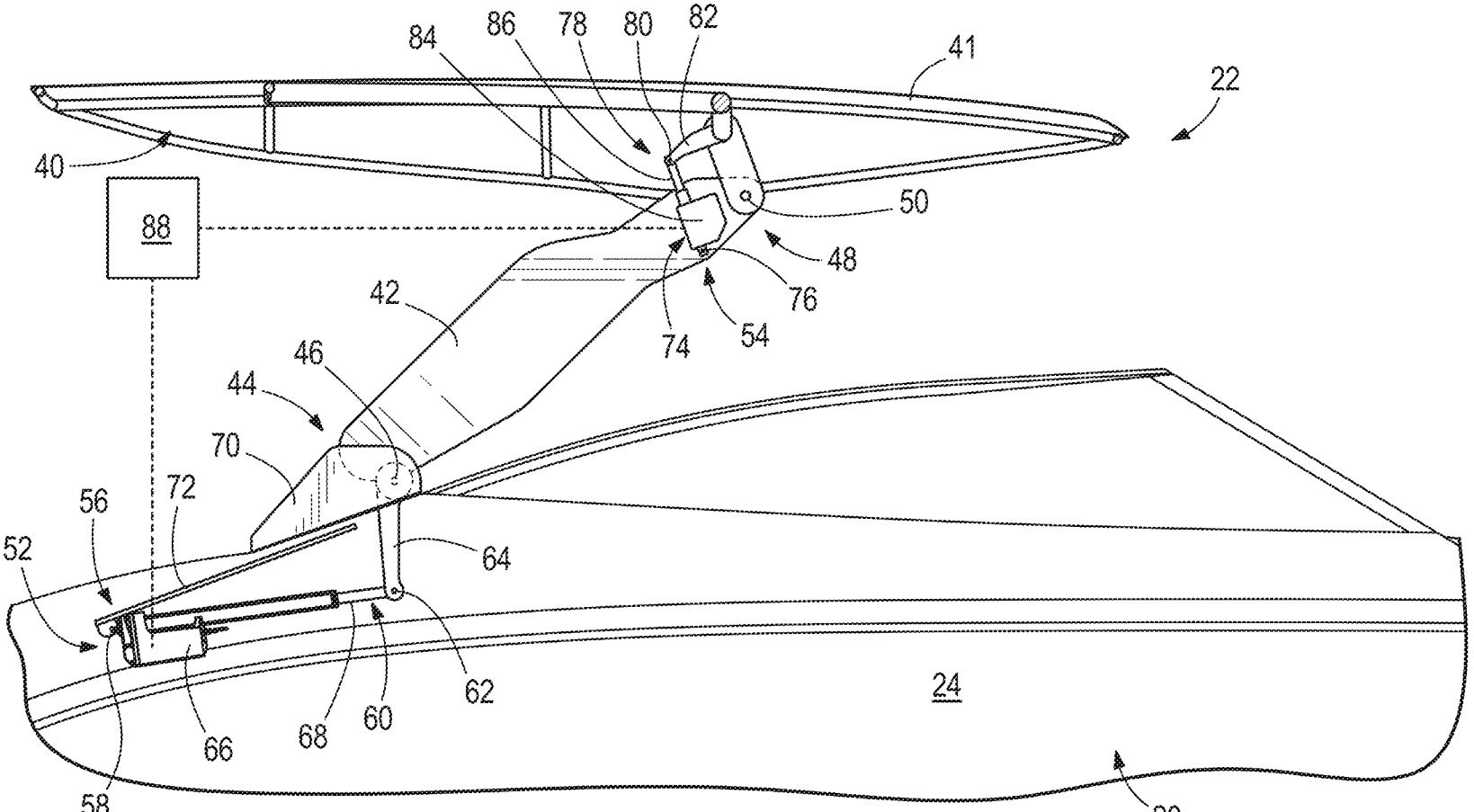
FIG. 5 is a sectional side view showing one side of the bimini top in the raised position.
Figure 6:
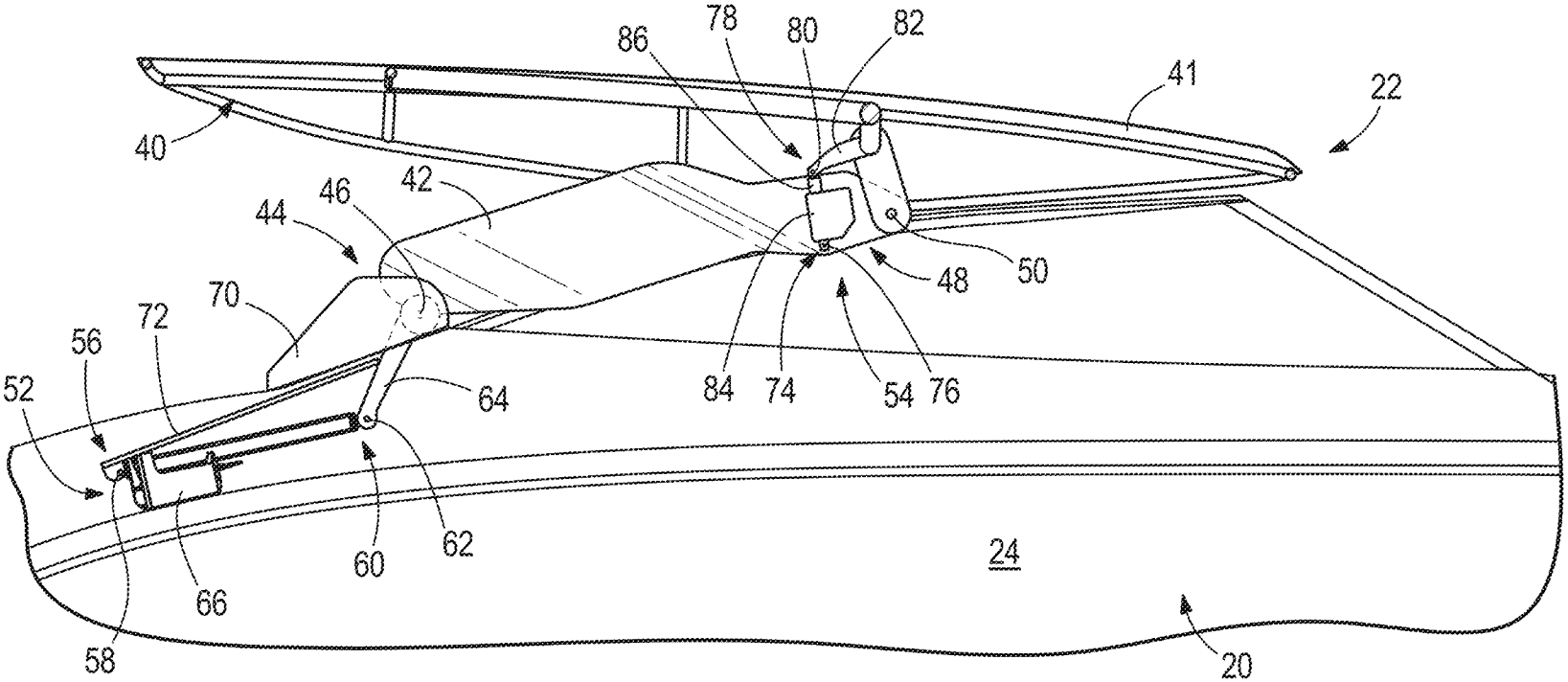
FIG. 6 is a sectional side view showing one side of the bimini top in the lowered position.
Figure 7:
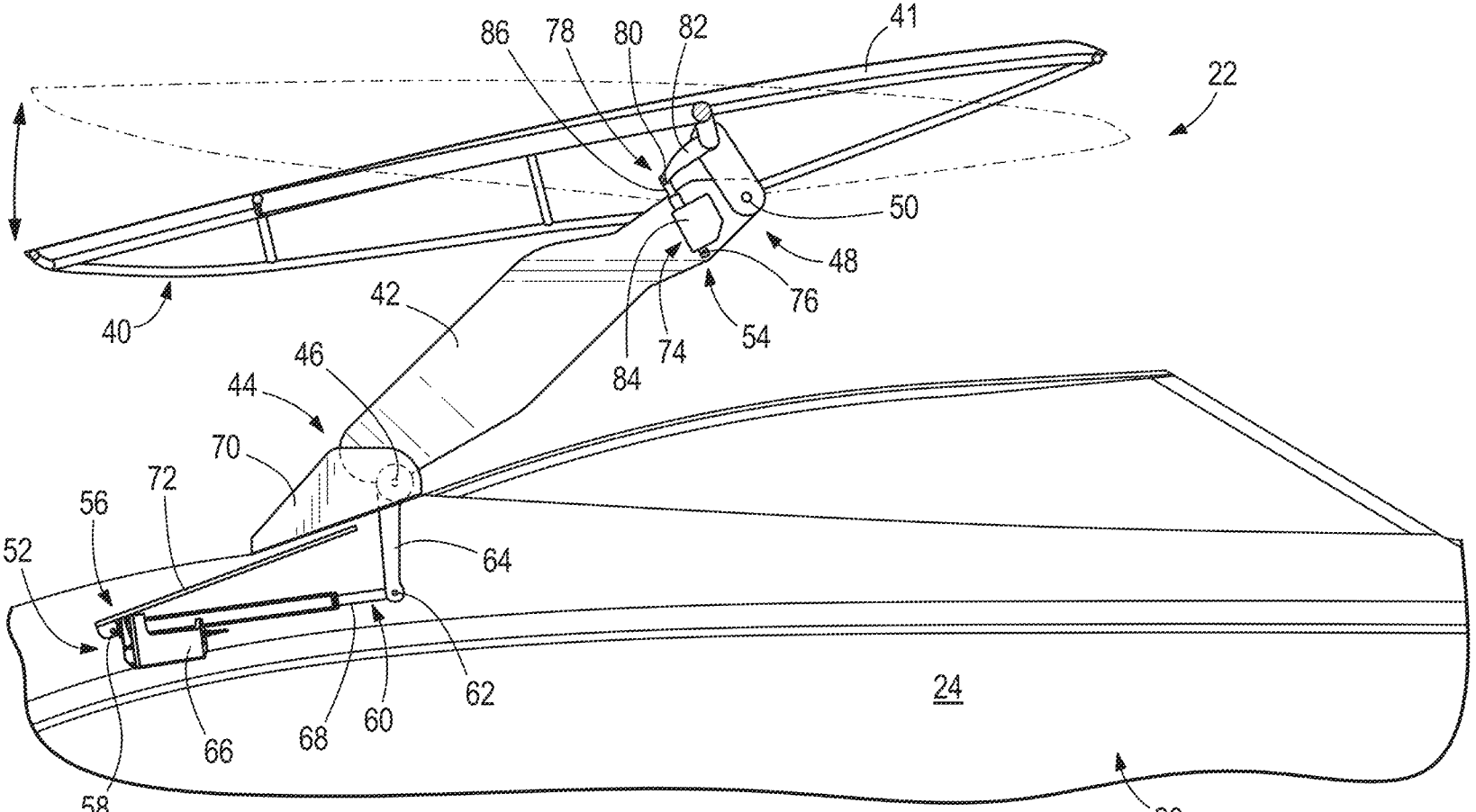
FIG. 7 is a sectional side view showing the cover frame of the bimini top in a sunshade position, in which the cover frame is angled relative to the hull of the marine vessel.

FIGS. 5 and 6 are sectional views showing only the port side of the bimini top 22. The port side of the bimini top 22 is essentially a mirror image of the starboard side of the bimini top 22. As such, it should be understood that the following description of the port side of the bimini top 22 equally applies to the starboard side of the bimini top 22. Each of the support arms 42 has a lower end 44 which is pivotably coupled to the marine vessel 20 via a lower pivot joint defining a lower pivot axis 46. Each of the support arms 42 also has an upper end 48 which is pivotably coupled to the cover frame 40 at an upper pivot joint defining an upper pivot axis 50. The nature of the lower and upper pivot joints is conventional and for example includes brackets fixed to the ends of the support arms 42, the hull of the marine vessel 20, and the cover frame 40. The brackets are connected together for example by one or more conventional fasteners or pivot pins along the noted lower and upper pivot axes 46, 50. Thus the support arms 42 are pivotable about the lower pivot axis 46, via the lower pivot joints, which in turn raises and lowers the cover frame 40, as can be seen by comparison of FIGS. 5 and 6. Referring to FIG. 7, the cover frame 40 is tiltable or pivotable forwardly and backwardly relative to the support arms 42, which determines the orientation of the cover frame 40 relative to the marine vessel 20, for example providing shade from the sun.

The bimini top 22 has port and starboard lower actuators 52 coupled to the lower ends 44 of the support arms 42, respectively, and to the hull 24 of the marine vessel 20. As further explained below, the lower actuators 52 are controllable and are configured to cause pivoting movement of the support arms 42 relative to the marine vessel 20, as shown by comparison of FIGS. 5 and 6.

Unlike prior art bimini apparatuses, the improved bimini top 22 according to the present disclosure also has port and starboard upper actuators 54 coupled to the upper ends 48 of the support arms 42, respectively, and to the cover frame 40. As further described herein below, the upper actuators 54 are also controllable, for example in synchrony with the lower actuators 52 and/or separately from the lower actuators 52. The upper actuators 54 are configured to pivot the cover frame 40 about the upper pivot axis 50 relative to the support arms 42, which provides control of the orientation of the cover frame 40 relative to the floor or deck 38 of the marine vessel 20, including but not limited to while the support arms 42 are stationary and/or while the support arms 42 are being pivoted relative to the marine vessel 20 by the lower actuators 52.

In the illustrated embodiment, the lower actuators 52 are linear actuators having a length which is extendible and retractable. The lower actuators 52 have a first end 56 pivotably coupled to the hull 24 of the marine vessel 20 via a pivot joint defining a pivot axis 58. The lower actuators 52 have an opposite, second end 60 pivotably coupled to the support arms 42, respectively, via lower lever arms 64. The lower lever arms 64 extend downwardly from the above-noted pivot joints defining the pivot axis 46 particularly at the lower ends 44 of the support arms 42, for example downwardly from the noted brackets. The lower lever arms 64 can be fixed to or formed with the support arms 42 so that these components pivot together about the noted pivot axis 46. The second ends 60 of the lower actuators 52 are pivotably coupled to the lower ends of the lower lever arms 64 at a pivot axis 62, which again can be defined by a fastener or pin.

In the illustrated embodiment, the lower actuators 52 include a conventional bidirectional electric motor 66 which is operable to telescopically extend and retract an extension rod 68 into and between the positions shown in FIGS. 5-6, which in turn pivots the lower lever arms 64 and thus also the support arms 42 into and between the noted raised and lowered positions relative to the marine vessel 20. Port and starboard base members 70 which can be for example castings, cover and include or support the noted brackets and are fixed to the hull 24. Mounting brackets 72 are for fastening the first ends 56 of the lower actuators 52 to the hull 24, as shown.

In the illustrated embodiment, the upper actuators 54 are linear actuators having a first end 74 which is pivotably coupled to the upper end 48 of the respective support arm 42 by a pivot pin defining a pivot axis 76. The upper actuators 54 have an opposite, second end 78 which is pivotably coupled to a lever arm 82 extending from and rigidly connected to or formed with the cover frame 40. The second end 78 of the upper actuator 54 is coupled to the outer end of the lever arm 82 by a pivot pin defining a pivot axis 80.

In the illustrated embodiment, the upper actuators 54 include a conventional bidirectional electric motor 84 which is operable to telescopically extend and retract an extension rod 86 into and between the positions shown in FIGS. 5 and 6, which pivots the cover frame 40 about the upper pivot axis 50 relative to the support arms 42. This type of actuator is well known in the art, and suitable examples are available for purchase from Linak US Inc. Extension of the upper actuators 54 pushes the outer end of the lever arm 82 and the pivot axis 80 clockwise in the view shown in FIG. 5, and thus the pivots the cover frame 40 clockwise about the upper pivot axis 50 relative to the support arms 42. Retraction of the upper actuators pulls the outer end of the lever arm 82 and pivot axis 80 counter-clockwise in the view shown in FIG. 5, and thus pivots the cover frame 40 counter-clockwise about the upper pivot axis 50 relative to the support arms 42 (from the perspective of the views shown in FIG. 5).

The type and configuration of the lower and upper actuators 52, 54 can vary from what is shown and described. In other embodiments, the lower and upper actuators 52, 54 can be hydraulic actuators and/or combination hydraulic-electric actuators, and/or a different type of mechanical actuator such as a worm drive driven by a bidirectional electric motor and/or the like, and/or a combination of any of the above.

In non-limiting embodiments, the lower and upper actuators 52, 54 can be controlled by one or more user input devices 88 (see e.g., FIG. 8) located with the bimini top 22 or located remotely from the bimini top 22, such as at the helm 39 in the embodiment shown in FIGS. 1-7. For example, the user input device(s), can include one or more manually operable electro-mechanical switches located at the helm 39 and communicatively connected by a wired or wireless link to the electric motors 66, 84 so that actuation of the switch(es) causes the electric motors 66, 84 to extend/retract the noted extension rods 68, 86. Optionally, the switches are momentary-style switches. Optionally, the switch(es) are three-way switches, wherein moving the respective switch into a first position causes the electric motors 66, 84 to extend the extension rods 68, 86, moving the respective switch into a different second position causes the electric motors 66, 84 to retract the extension rod 68, 86, and moving the respective switch into a different third position causes the electric motors 66, 84 to stop movement of the extension rods 68, 86.

In some embodiments, a single switch can be provided for simultaneously controlling both of the lower and upper actuators 52, 54. In other embodiments, two or more dedicated switches can be provided for separately controlling the lower and upper actuators 52, 54. In embodiments having dedicated switches for each of the lower and upper actuator 52, 54, an additional one or more switches can be provided for simultaneously controlling the lower and upper actuators 52, 54. In these embodiments, by operation of a dedicated switch corresponding to the upper actuator 54, the cover frame 40 can be independently pivoted relative to the support arms 42, for example as shown in FIG. 7, into a variety of tilted or angled (sunshade) positions, including both forwardly and backwardly angled or tilted positions. Optionally, this can occur while the support arms 42 remain stationary, or optionally this can occur while the support arms 42 are being moved by the lower actuators 52. It will thus be understood the above-described embodiments of the bimini top 22 advantageously enables a user to control the angle of the cover frame 40 relative to the support arms 42, for example in situations where the user desires to provide sunshade to someone standing on the deck 38. In other examples, by enabling tilting of the cover frame 40 relative to the support arms 42, the improved bimini top 22 advantageously allows the user easier access to items which may be temporarily stored in the cover frame 40, for example wakeboards, paddleboards, surfboards and/or the like.

In some embodiments, and particularly in embodiments having a dedicated switch for simultaneously controlling both of the lower and upper actuators 52, 54, the speeds of the lower and upper actuators 52, 54 are calibrated relative to each other during setup of the bimini top 22 so that while the lower actuators 52 are extended or retracted, the upper actuators 54 are automatically extended or retracted at the necessary speed and amount to continuously maintain the cover frame 40 in the generally horizontal orientation shown in the figures. Calibrating the relative speeds of the lower and upper actuators 52, 54 for example can be accomplished by known actuators which are available for purchase, for example from Linak US Inc. Such actuators commonly have an internal controller or "IC" which is programmed by the manufacturer to enable reduction of the speed of the actuator. For example the IC limits the voltage to the electric motor 84, which slows the internal gearing of the actuator, thus slowing the speed the extension rod 68 extends or retracts. This feature can be calibrated by the technician during installation, particularly for whichever of the lower and upper actuators 52, 54 are set to move faster than the other, so that the lower and upper actuators 52, 54 move in synchrony in a way that maintains a horizontal attitude of the cover frame 40 relative to the deck 38.

Figure 8:
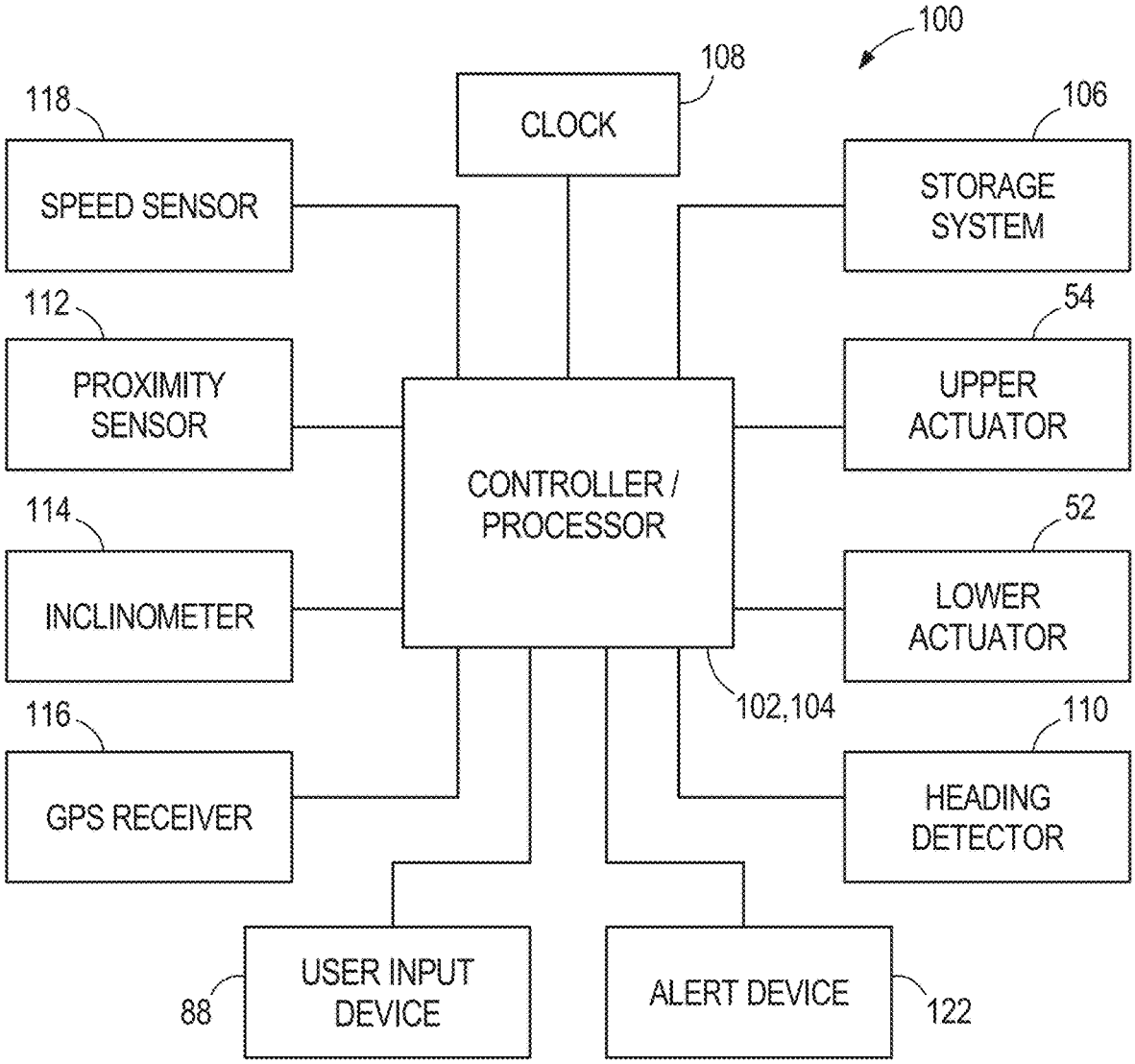
FIG. 8 is a schematic of an example bimini top system.

FIG. 8 depicts an embodiment of a bimini top system 100 having a controller 102 for controlling actuation of the lower and upper actuators 52, 54 and the user input device 88. The controller 102 has a processor 104 which is communicatively connected to a storage system 106 comprising a computer readable medium that includes volatile or non-volatile memory upon which computer readable code and data is stored. The processor 104 can access the computer readable code and, upon executing the code, carry out functions, such as the controlling functions for the bimini top 22, as further described below. In alternate embodiments the controller 102 is part of a larger control network such as a controller area network (CAN) or CAN Kingdom network, such as disclosed in U.S. Pat. No. 6,273,771. A person of ordinary skill in the art will understand in view of the present disclosure that various other known and conventional computer control configurations could be implemented and are within the scope of the present disclosure, and that the control functions described herein may be combined into a single controller or divided into any number of distributed controllers which are communicatively connected.

In the illustrated embodiment, the controller 102 is in electrical communication with the lower and upper actuators 52, 54 via one or more wired and/or wireless links, as shown by lines and arrows in FIG. 8. In some embodiments, the wired and/or wireless links are part of a network, as described above. The controller 102 is configured to control the lower and upper actuators 52, 54 by sending and optionally by receiving said signals via the wired and/or wireless links. In the illustrated embodiment, the controller 102 is configured to send electrical signals to the lower and upper actuators 52, 54 which cause the electric motors 66, 84 to operate in a first direction to extend the extension rods 68, 86, and which alternately cause the electric motors 66, 84 to operate in an opposite, second direction to retract the extension rods 68, 86. In non-limiting embodiments, the controller 102 is configured to control the lower and upper actuators 52, 54 only to move into fully retracted and extended positions. In other non-limiting embodiments, the controller 102 is configured to control the lower and upper actuators 52, 54 into incremental length positions between fully retracted and extended positions. In non-limiting embodiments, the controller 102 is configured to have independent control over the upper actuators 54 and the lower actuators 52, so that the controller 102 can independently control the lower actuators 52 apart from the upper actuators 54, and so that the controller 102 can independently control the upper actuators 54 apart from the lower actuators 52. The functional benefits of independent control over the lower and upper actuators 52, 54 are explained herein above and below.

In non-limiting embodiments, the controller 102 is configured to automatically control a speed and direction of operation of the electric motors 66, 84. In non-limiting embodiments, the controller 102 is configured to control the both the speeds and the directions of operation of the electric motors 66, 84 in particular so that while the lower actuators 52 are operated to pivot the support arms 42 (and thus change the vertical position of the cover frame 40 and associated cover 41 relative to the hull 24 of the marine vessel 20), the upper actuators 54 are operated at a speed which is calibrated to effectively match the speed of operation of the lower actuators 52 so that the cover frame 40 and associated cover 41 maintain a substantially constant, horizontal orientation during the change in vertical position. In non-limiting examples, a dataset correlating the speed(s) of the lower and upper actuators 52, 54 which are necessary to maintain the horizontal orientation of the cover frame 40 is stored in the storage system 106 at set up, and thereafter is accessible by the processor 104. The controller 102 can be programmed to control the lower and upper actuators 52, 54 according to the dataset and thus to consistently maintain the horizontal orientation of the cover frame 40.

In non-limiting embodiments, the controller 102 is configured to control the upper actuators 54 separately from the lower actuators 52 to enable pivoting of the cover frame 40 relative to the support arms 42 while the support arms 42 remain stationary, or optionally also while the support arms 42 are moving. As shown by solid and dash-and-dot lines in FIG. 7, pivoting of the cover frame 40 relative to the support arms 42, for example while the support arms 42 are stationary, moves the cover frame 40 into a new orientation relative to the support arms 42 (shown in solid lines), for example when desired to provide sunshade and/or rain cover to a person in the boat. As described above, this functionality could also advantageously provide easier access for the user to items which are temporarily stored in on the cover frame 40, for example wakeboards, paddleboards, surfboards, and/or the like.

In non-limiting embodiments, the user input device 88 is configured to input a user-desired position the bimini top to the controller 102. Upon input of the user-desired position, the controller 102 is programmed to control the lower and/or upper actuators 52, 54 to move the bimini top 22 into the user desired position. The user input device 88 can include any conventional device which can be communicatively connected to the controller 102 for inputting a user-desired position to the controller 102, including but not limited to one or more switches, joysticks, touch pads, touch screens, and/or the like.

In a non-limiting example, the user input device 88 includes a touch screen which is communicatively connected to the controller 102. The touch screen can be located with the bimini top 22 or located remotely therefrom, for example at the helm 39 or on a personal handheld device such as a cell phone, or the like. The communicative connection between the touch screen and the controller 102 can be wired or wireless, including optionally via Bluetooth. In non-limiting embodiments, the controller 102 is configured to be remotely controllable via the user input device 88 by a person located apart from the marine vessel 20, for example from shore or by a person being towed by the marine vessel during watersports.

In non-limiting embodiments, the controller 102 and user input device 88 are configured to present the user with the ability to select from a plurality of sunshade positions of the cover frame 40 relative to the support arms 42, for example on a touch screen. The sunshade positions are stored in the storage system 106 and accessible by the processor 104. A dataset correlating lengths of the upper actuator 54 to the various sunshade positions the storage system 106. User selection of one of the stored sunshade positions via the user input device 88 causes the controller 102 to access the dataset and then control the upper actuators 54 based on the selected sunshade position to pivot the cover frame 40 to the selected position.

In non-limiting embodiments, the controller 102 and user input device 88 are configured to present the user with a plurality of vertical positions of the cover frame 40 relative to the marine vessel 20, for example on a touch screen, including for example a fully raised position (FIG. 2), a fully lowered position (FIG. 3), and/or any number of positions in between. A dataset correlating lengths of the lower actuator 52 to vertical positions of the cover frame 40 is calibrated and stored in the storage system 106. User selection of one of the vertical positions via the user input device 88 causes the controller 102 to access the dataset and then control the lower actuators 52 based on the selected vertical position to pivot the support arms 42 and cover frame 40 into the selected position. In this example, preferably, the controller 102 simultaneously controls the speeds of lower and upper actuators 52, 54 during movement thereof to maintain the horizontal orientation of the cover frame 40 as described herein above. In other embodiments, the speeds of the lower and upper actuators 52, 54 are pre-set during calibration of the bimini top 22 and the lower and upper actuators 52, 54 only operate at the pre-set speed, which is calibrated, as described herein above, to maintain the horizontal orientation of the cover frame 40.

In non-limiting embodiments, the controller 102 is programmed to automatically control the lower and upper actuators 52, 54 depending upon any of several characteristics of the marine vessel 20, including but not limited to time of day provided to the controller 102 by a clock 108 and current heading of the marine vessel 20, which is detected and provided to the controller 102 by a conventional heading detector 110. An example of a suitable heading detector is an electronic compass, such as the Precision Nine compass available for purchase from Navico, which can provide the controller 102 with the current heading of the marine vessel 20.

In non-limiting examples, a dataset correlating time of day and current heading of the marine vessel 20 to preferred sunshade positions of the cover frame 40 is stored in the storage system 106 and accessible by the processor 104. Depending on the time-of-day input to the controller 102 by the clock 108, the controller 102 can be programmed to automatically control the upper actuators 54 to tilt the sunshade into an appropriate sunshade position, which position can also be based on the current heading of the marine vessel 20. For example, if according to the heading detector 110 the bow 28 of the marine vessel 20 is facing east, and according to the clock 108 the time is in the late afternoon, the controller 102 can be configured to automatically control the upper actuator 54 to pivot the cover frame 40 rearwardly about the support arms 42 into the tilted (sunshade) position shown in FIG. 7. Optionally, the controller 102 can be configured to first provide a warning to the operator of the marine vessel 20 via the user input device 88 and/or require the operator of the marine vessel 20 to first authorize the movement via the user input device 88 before enacting the change in sunshade position.

It will thus be understood by those having ordinary skill in the art that the present disclosure provides improved bimini top apparatuses which enable independent control over the angle of the cover frame 40 relative to the support arms 42 and relative to the marine vessel 20, which in turn permits automated control by the controller 102, for example during certain times of the day or in certain locations to provide sunshade cover, for example.

It will also thus be understood by those having ordinary skill in the art that the above-described embodiments provide improved bimini top apparatuses which can be made more streamlined than the prior art, in particular by omitting the noted mechanical linkage, but yet retain the ability to control the orientation of the cover frame 40 and associated cover 41, preferably for example so that the cover frame 40 and cover 41 remain in a generally horizontal orientation during pivoting movement of the support arms 42, and also for example so that the cover frame 40 is independently pivotable relative to the support arms 42, for example to provide rain cover or sunshade.

During further research and development, the present inventors have determined it would be desirable to provide improved convertible bimini top systems for use with marine vessels, such as the exemplary marine vessel 20 having the deck 38 and preferably being configured so that the bimini top 22 including cover frame 40 extending over the deck 38 is automatically raised and lowered relative to the deck based upon an existence of an obstruction object proximate to the marine vessel 20. Such arrangements advantageously will prevent damage to the bimini top 22 which otherwise might occur if the bimini top 22 impacts a bridge or other obstruction object. The automatic nature of such systems can advantageously be facilitated by the above-described controller 102 in combination with the above-described lower and/or upper actuators 54, 52, which are communicatively coupled to the controller 102. Various embodiments of such convertible bimini top systems are described herein below with reference to FIGS. 8-17.

Referring to FIG. 8, the system 100 comprises the above-described controller 102 having the processor 104 and the storage system 106. Optionally the system 100 also comprises the heading detector 110. Optionally, the system 100 also comprises the user input device 88 and the lower and upper actuators 52, 54; however, it is not necessary for the system 100 to have a user input device 88, and in some examples described herein below the system 100 comprises only one actuator configured to raise and lower the bimini top, for example the lower actuator 52, which can be configured according to the above-described embodiments and/or in accordance with any known single-actuator example, such as disclosed in the presently incorporated U.S. Pat. No. 9,434,451. Additional components of the system optionally comprise one or more proximity sensors 112 which for example can include a lidar sensor and/or the like, one or more inclinometers 114, and one or more Global Positioning System (GPS) receivers 116. Optionally, the system 100 can also include one or more speed sensors 118. The proximity sensor 112, inclinometer 114, GPS receiver 116, and speed sensor 118 are conventional items, the configuration of which can vary. The proximity sensor 112, inclinometer 114 GPS receiver 116, and speed sensor 118 are communicatively connected to the controller 102 via a wired or wireless links, as shown in FIG. 8.

An example of a suitable lidar sensor is the JFL110 3D Flash LIDAR, made by Continental and commercially available for purchase from various online providers. This example contains a number of radar and color sensors configured to create a three-dimensional profile of the vessel's surroundings. The lidar sensor generates high-resolution 3D point cloud data to the controller 102 and can also be combined with additional two-dimensional cameras enhancing reliability in a wide range of weather conditions. Other types of proximity sensors could be implemented instead of or in addition to the above-described lidar sensor, including for example radars, sonars, cameras, lasers (e.g., lidars or Leddars), Doppler direction finders, and/or other devices capable of determining both the distance and direction (at least approximately), i.e., the relative position of an obstruction with respect to the marine vessel 20, such as a dock, a seawall, a slip, another vessel, a large rock or tree, etc. Camera sensors may be used, alone or in combination with any of the sensors mentioned above to provide object proximity information to controller 102. In another particular example the proximity sensor 112 includes one or more conventional stereo-optic camera(s) which generate(s) a disparity map instead of the point cloud, to judge distance.

Note also that the controller 102 may selectively operate any one or more of a plurality of sensors (including radars, lidars, Leddars, ultrasonics, and cameras) to sense the distance and the direction of the object with respect to the marine vessel 20. Alternatively, the controller 102 may use all available sensor data from all sensor types, which may be reviewed real time as it is received or may be formulated into one or more maps or occupancy grids integrating all proximity measurement data, where the mapped data from all the operated sensors is processed as described herein. In such an embodiment, the proximity measurements from each of the various sensors are all translated into a common reference frame.

An example of a suitable inclinometer 114 is the SXZ120T Voltage Type Dual Axis Inclinometer and Tilt sensor available for purchase online via for example Amazon.com. This example is configured to provide the controller 102 with reliable three-axis (pitch, roll, yaw) data corresponding to the position of the marine vessel 20 relative to horizontal.

A variety of suitable GPS receivers are commercially available for purchase from Lowrance. The GPS receiver 116 is configured to provide the controller 102 with the current, actual geographic location of the marine vessel 20 in latitude and longitude. For example, the GPS receiver 116 can update the actual geographic location of the marine vessel 20 as the marine vessel 20 is navigated under the command of the controller 102. The GPS receiver 116 can also determine the speed of the marine vessel 20 over water by determining how far the marine vessel 20 travels, as determined from GPS position, over a given period. In some examples, the GPS receiver 116 and the heading detector 110 are integrated in a single device.

The GPS receiver 116 may be suitable to function as the speed sensor 118. In other examples, the speed sensor 118 can be any conventional speedometer for providing speed of the marine vessel 20 in the body of water.

The devices illustrated in FIG. 8 are located on the marine vessel 20 in any position which facilitates the below-described functionalities. For example, the controller 102, storage system 106, clock 108 and user input device 88 can be located at the helm 39. The actuator (e.g., lower and upper actuators 52, 54) for lowering and raising the bimini top 22 is typically located on the bimini top 22 itself, for example as shown in FIGS. 1-7. In general, the proximity sensing devices (examples described above) are positioned to detect the presence of objects in the environment surrounding the marine vessel 20, such as a dock, swimmer, or any other obstruction in the path of the vessel. Each sensor reports proximity relative to its own frame of reference—i.e., the distance from the sensor to the object as measured along the view angle of the sensor. Depending on the type of sensor, the application of use, boat size, hull shape, etc., multiple sensor types and sensor locations may be required to provide adequate proximity sensing around the marine vessel 20 for operation in all marine environments. To create a cohesive dataset which can be used for purposes of vessel control and vessel navigation, the data sources are preferably translated to a common reference frame. This requires precise knowledge of the location and orientation of each sensor relative to the common reference frame so that the data measured therefrom can be translated appropriately. Further description of suitable proximity sensing devices, which are known in the art, is provided in the above-incorporated U.S. Patent Publication No. 2020/047518

Figure 9:
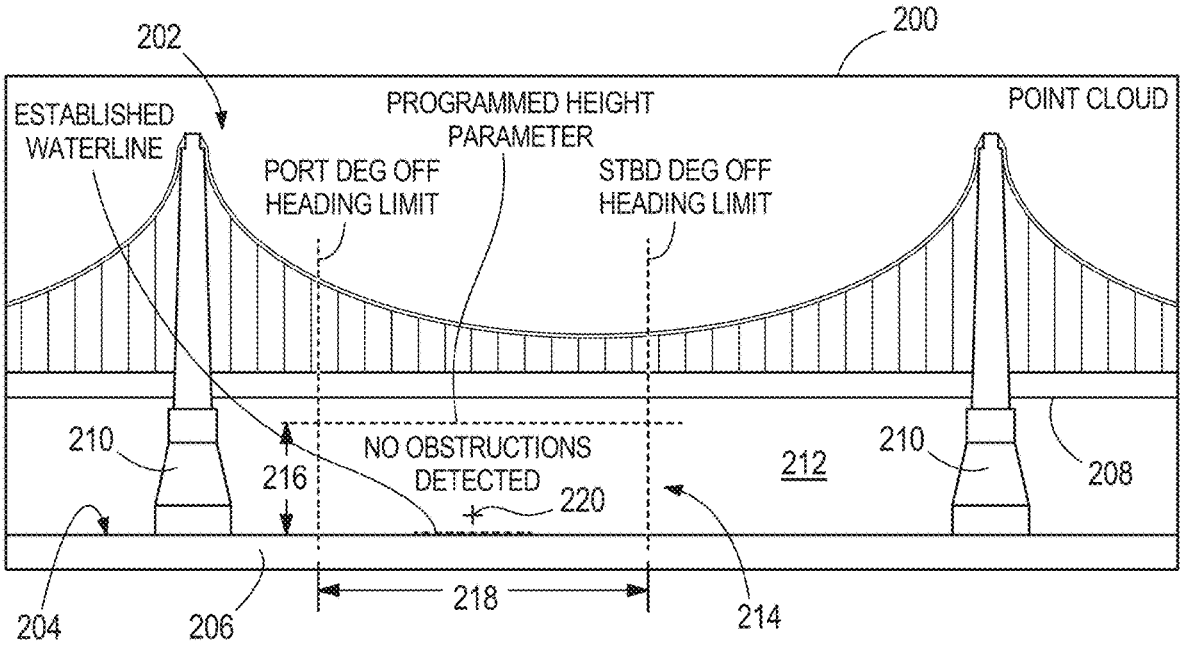
FIG. 9 is an example dataset representing geographical terrain proximate to the marine vessel, which is sensed by a proximity sensor, and showing a zone of travel for the marine vessel which is free of any obstruction.

FIG. 9 depicts an exemplary dataset based on an output from the proximity sensor 112. In this example, the proximity sensor 112 includes a lidar sensor which outputs a dataset 200 consisting of point cloud data to the controller 102. The dataset 200 is representative of the geographical terrain proximate to the marine vessel 20, which in this example includes a bridge 202, and more particularly superstructure portions of the bridge 202 which are located above the surface or waterline 204 of the body of water 206 in which the marine vessel 20 is situated. The superstructure portions of the bridge 202 include a bridge deck 208 which is supported above the body of water 206 by a pair of bridge columns 210. An open area 212 is defined laterally between the bridge columns 210 and vertically between the waterline 204 and bottom of the bridge deck 208. Each of the above items is sensed by the proximity sensor 112 and communicated to the controller 102. Obviously, the dataset 200 shown in FIG. 9 is merely exemplary and the dataset that is output by the proximity sensor 112 can widely vary depending on the location of the marine vessel 20 and the geography proximate to the marine vessel 20. In other examples, the dataset can be representative of geographical terrain including any variety of objects proximate to the marine vessel 20 and sensed by the proximity sensor 112.

FIG. 9 also depicts a zone of travel 214 for the marine vessel 20, which is delineated by the controller within the dataset 200. The shape/size of the zone of travel 214 is calibrated during setup of the system 100 and can vary depending on the desired functionality of the system 100. In the illustrated example, the controller 102 is programmed to delineate (i.e., identify or create) the zone of travel 214 in the dataset 200 based on a height range 216 and a width range 218 which are stored in the memory of the storage system 106. The height range 216 is a stored vertical distance above the waterline 204 which is greater than the known height of the marine vessel 20 above the waterline 204, with the bimini top 22 in the raised position shown in FIGS. 1-2, plus an added factor of safety to account for vertical movement of the marine vessel 20 for example during wavy conditions of the body of water 206. For example if the marine vessel 20 with the bimini top 22 in the raised position typically extends vertically above the waterline 204 by 30 feet, the stored vertical distance may be from a lower threshold of 0 feet to an upper threshold of 40 feet, which would account for even extreme additional vertical movement of the marine vessel 20 due to waves. The width range 218 is a stored horizontal distance, which is greater than the width of the marine vessel 20 from port to starboard sides, plus a factor of safety to account for lateral movement of the marine vessel 20 due to wind or waves and/or to account for items hanging outside the marine vessel 20 such as fishing poles, etc. For example, if the marine vessel 20 from port side to starboard side is 20 feet, the stored horizontal distance can be 30 feet, which is equally allocated to the port and starboard sides of the heading of the marine vessel 20 sensed by the heading detector 110, which designates a lateral mid-point 220 of the zone of travel 214. In other words, according to this example the zone of travel 214 would extend 15 feet to the port side of the heading of the marine vessel 20 and 15 feet to the starboard side of the marine vessel 20.

It will thus be understood from the dataset 200 depicted in FIG. 9 the zone of travel 214 for the marine vessel 20, which accounts for situations where the bimini top 22 is in the raised position, is located safely within the open area 212 under the bridge deck 208 and between the bridge columns 210 such that the marine vessel 20 will safely pass through the bridge 202 in the zone of travel 214.

Figure 10:
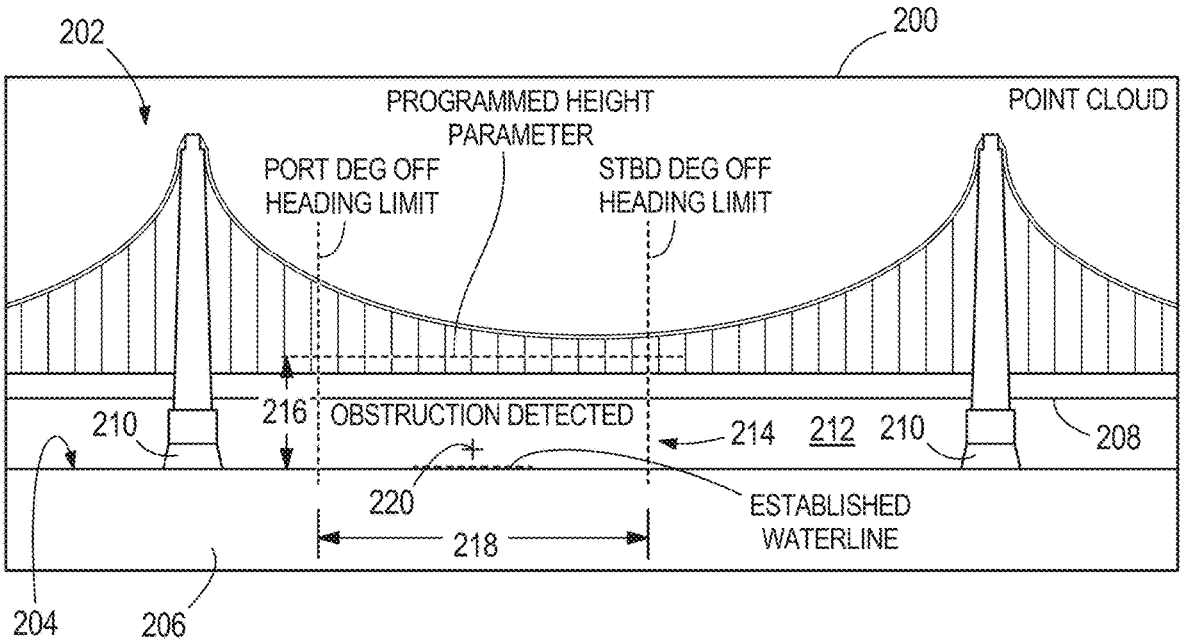
FIG. 10 is a view like FIG. 9, showing an obstruction in the zone of travel.

FIG. 10 depicts another exemplary dataset 200 based on an output from the proximity sensor. In this example, the proximity sensor 112 outputs point cloud data showing the bridge deck 208 within the zone of travel 214 for the marine vessel 20 and as such represents an "obstruction" to travel of the marine vessel 20. Specifically, the height of the bottom of the bridge deck 208 is lower than the height range 216 stored in the memory of the storage system 106. Based on this information, the controller 102 is programmed to take corrective action necessary to prevent the marine vessel 20 from impacting the bridge 202. Corrective actions taken by the controller 102 can include controlling an alert device 122 to alert an occupant and/or operator of the marine vessel 20 to the issue and/or automatically controlling the upper actuator 54 to lower the cover frame 40 and associated cover 41. Exemplary corrective actions which can be taken by the controller 102 will be further described herein below with reference to FIGS. 13-17.

Figure 11:
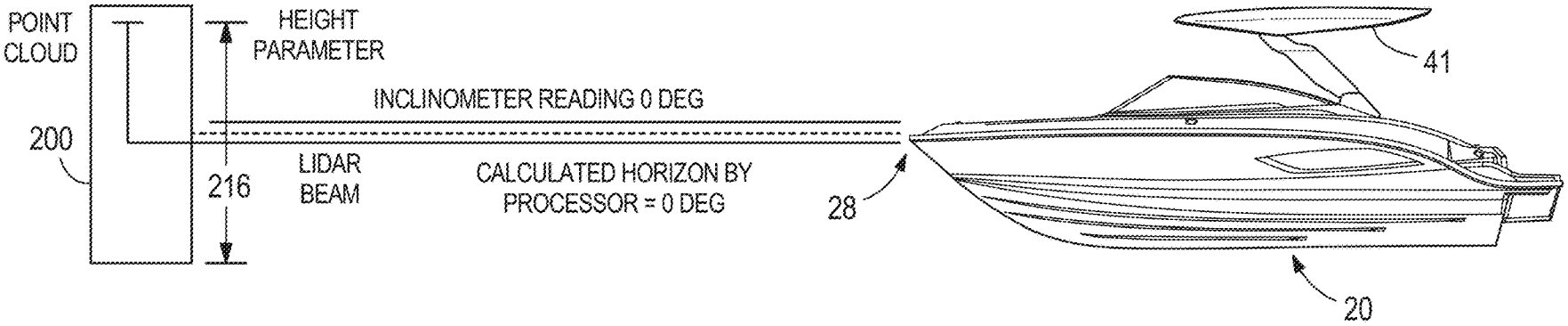
FIG. 11 is a schematic depicting the system sensing the height of an obstruction to the marine vessel relative to the waterline of a calm body of water.
Figure 12:
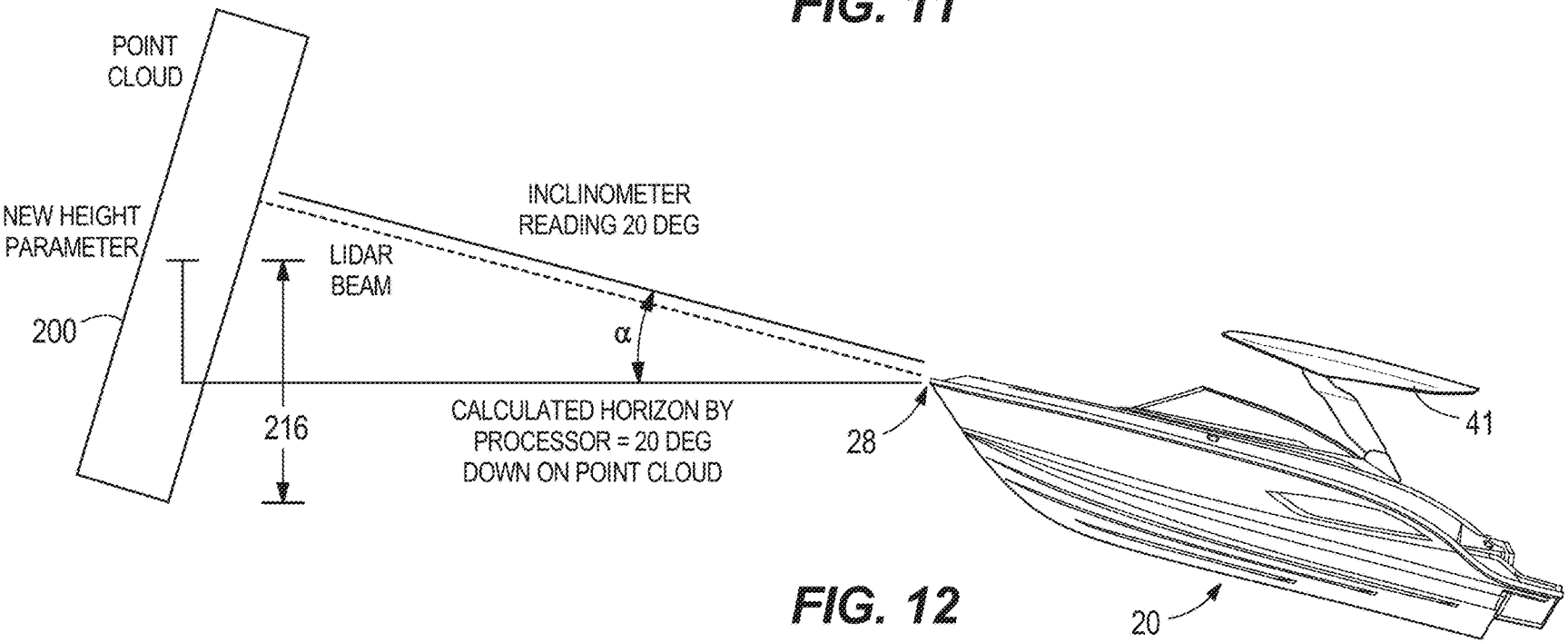
FIG. 12 is like FIG. 11 depicting the marine vessel in an inclined position relative to the waterline.

Referring to FIGS. 11-12, in preferred embodiments, the controller 102, in its delineation of the zone of travel 214, which as explained above provides a basis on which the controller 102 is configured to take corrective action, is advantageously configured to account for the angle of inclination of the marine vessel 20 relative to horizontal or relative to the body of water 206.

FIG. 11 depicts a situation where the marine vessel 20 is situated at rest in a calm body of water 206, and as such the bow 28 of the marine vessel 20 extends generally parallel to and above the waterline 204. In this situation, the inclinometer 114 reads a zero angle of inclination relative to horizontal. It will be understood by one having ordinary skill in the art that the actual location of the waterline 204 relative to the marine vessel 20 and thus relative to the various sensors on the marine vessel 20 (which as explained above may be mounted on the bow 28, on the bimini top 22, or the like) will vary depending on various factors including the shape and configuration of the hull, the weight of the marine vessel 20, and the like. However from experience and/or through trial and error during calibration of the system 100, the expected location of the waterline 204 relative to the marine vessel 20 and particularly relative to the proximity sensor 112 is identified. This expected location of the waterline 204 when the marine vessel 20 is at rest in a calm body of water 206 is stored in the memory of the storage system 106 and represents a "virtual waterline" when the marine vessel 20 is at rest in a calm body of water 206. In use, when the inclinometer 114 senses that the marine vessel 20 is at a zero angle of inclination relative to horizontal, the controller 102 is configured to assume that the marine vessel 20 is situated at rest in a calm body of water 206 and sets the lower threshold of the height range 216 of the zone of travel 214 at the stored virtual waterline. For example, with regards to the above-described embodiment having a height range 216 with a lower threshold of 0 feet and an upper threshold of 40 feet, when the inclinometer 114 reads a zero degree angle of inclination relative to horizontal, the controller 102 sets the lower threshold (zero) at the location of the stored virtual waterline in the dataset 200 and sets the upper threshold at 40 feet vertically upwardly from the stored virtual waterline.

FIG. 12 depicts a situation where the marine vessel 20 is being operated at a cruising speed, and as such the bow of the marine vessel 20 is inclined upwardly at an angle of inclination a relative to the body of water 206. In this situation, the controller 102 is advantageously configured to adjust the location of virtual waterline it applies to the dataset 200, in particular to account for the angle of inclination a. In other words, the controller 102 is configured to automatically shift the height range 216 of the zone of travel 214 downwardly in the dataset 200 by the angle of inclination a, to account for the fact that the marine vessel 20 and proximity sensor 112 is tilted upwardly when the marine vessel 20 is at cruising speed. For example when the inclinometer 114 reads a 20 degree angle of inclination relative to horizontal, the controller 102 is configured to automatically shift the height range 216 of the zone of travel 214 downwardly by 20 degrees in the dataset 200, as shown in FIG. 12.

Figure 14:
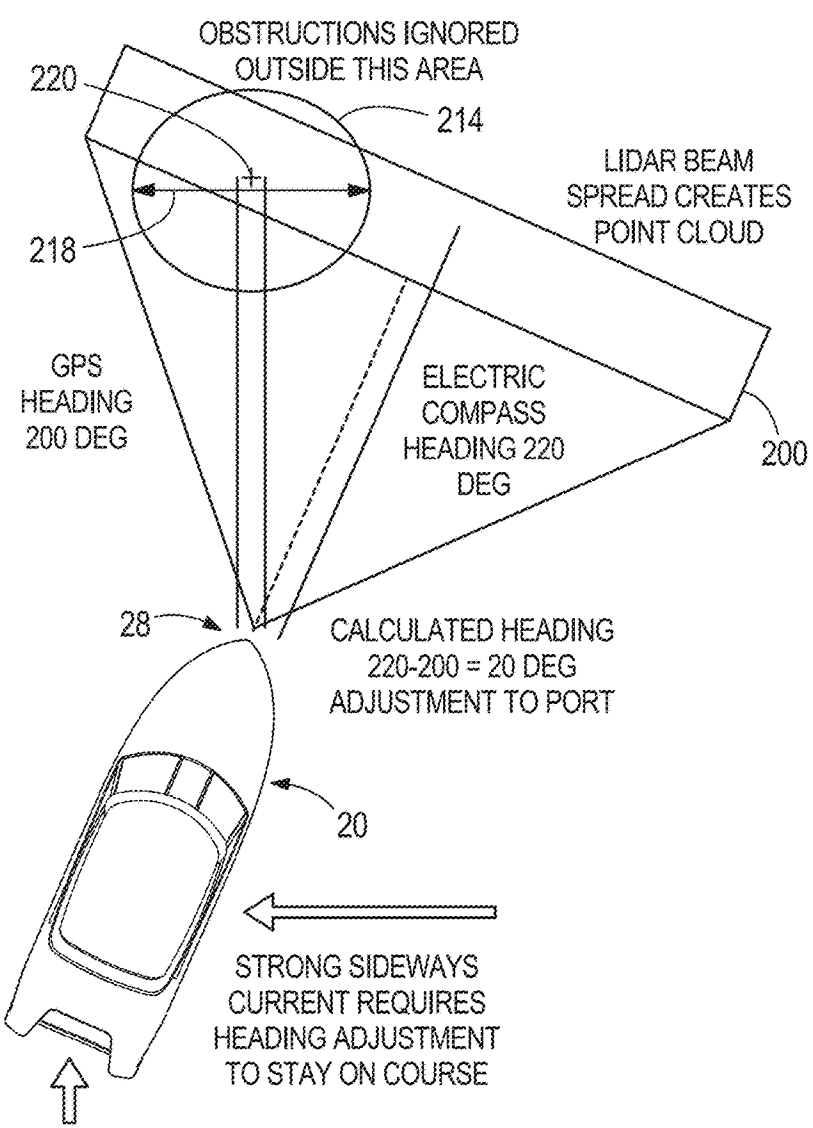
Figure 13:
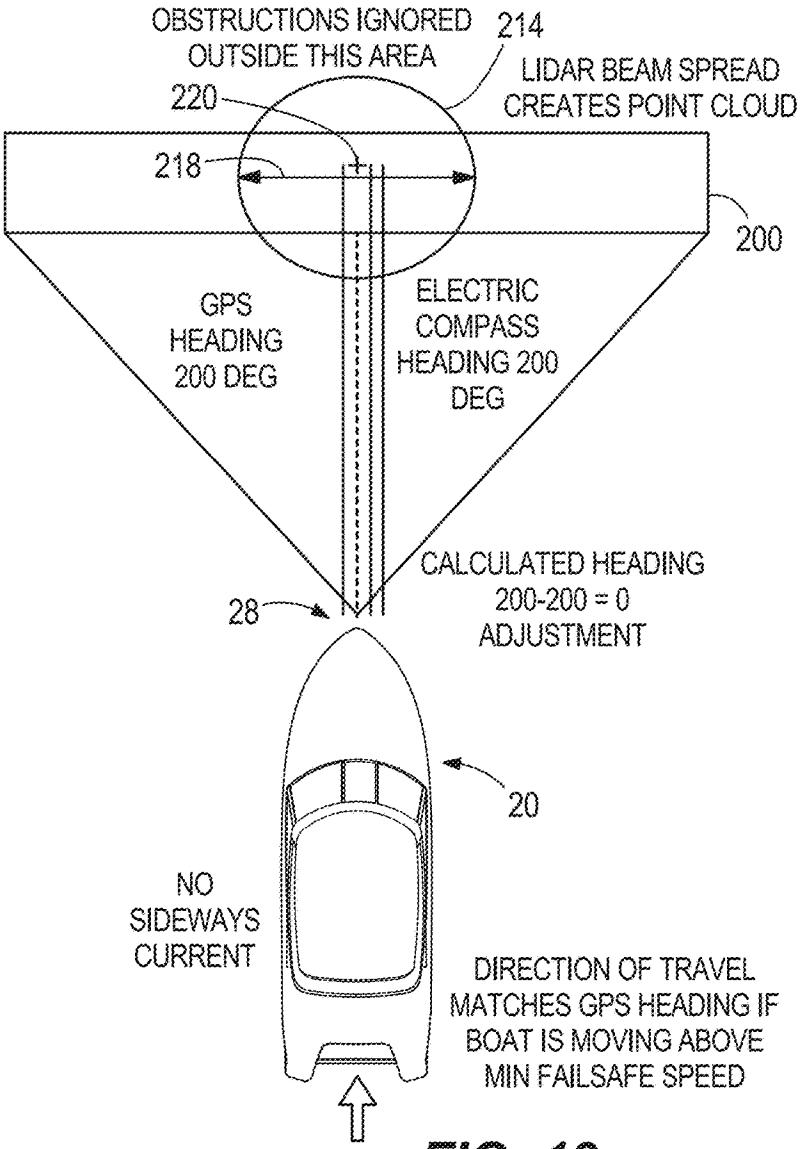
FIG. 13 is a schematic depicting the system sensing an obstruction when the marine vessel is traveling in the same direction as the heading of the marine vessel.

Referring to FIGS. 13-14, in preferred embodiments, the controller 102, in its delineation of the zone of travel 214, which as explained above provides a basis on which the controller 102 is configured to take corrective action, is advantageously configured to account for a situation where the heading of the marine vessel 20 is different than the actual direction of travel of the marine vessel 20.

FIG. 13 depicts a situation where the heading detector 110 detects that the heading of the marine vessel 20 is the same as the actual direction of travel of the marine vessel 20 detected by the GPS receiver 116. In this situation, the controller 102 is configured to laterally set the lateral mid-point 220 of the zone of travel 214 along the heading of the marine vessel 20, which in this example is the same as the actual direction of travel of the marine vessel 20. Thus, just like the embodiment described herein above with reference to FIG. 10, the zone of travel 214 has a width range 218 which equally extends to the port and starboard sides of the heading of the marine vessel 20.

FIG. 14 depicts a situation where the heading of the marine vessel 20 (i.e, the direction in which the bow 28 is pointing), as detected by the heading detector 110 is different than the actual direction of travel of the marine vessel 20 (i.e, the path along which the marine vessel 20 is traveling) detected by the GPS receiver 116. This often occurs during operation of a marine vessel 20 in wind, waves, current, and the like. In this situation, the controller 102 is advantageously configured to account for this difference when it delineates the zone of travel 214 in the dataset 200. More specifically, the proximity sensor 112 is fixed to the marine vessel 20 and thus it senses the surroundings of the marine vessel 20 from the frame of reference of the heading of the marine vessel 20 as opposed to the frame of reference of the actual direction of travel of the marine vessel 20. However when the controller 102 delineates the zone of travel 214 in the dataset 200, it is preferable to locate the lateral mid-point 220 of the zone of travel 214 along the direction of travel of the marine vessel 20, in particular such that the zone of travel 214 equally laterally extends with respect to the port and starboard sides of direction of travel identified by the GPS receiver 116. To accommodate this situation, the controller 102 is configured to determine a difference between the heading of the marine vessel 20 and the actual direction of travel of the marine vessel 20 and then adjust the lateral mid-point 220 of the zone of travel 214 to the actual direction of travel. In the non-limiting example shown in FIG. 14, the heading detector 110 detects a heading of 220 degrees, whereas the GPS receiver 116 detects a direction of travel of 200 degrees. As such, in this example the controller 102 is configured to adjust the lateral mid-point 220 of the zone of travel 214 by 20 degrees so that the lateral mid-point is located along the direction of travel.

In additional examples, the present inventors have determined it would be advantageous to configure the system 100 to automatically take corrective action, such as alerting the operator and/or lowering the bimini top 22, as further described below, based upon the current global position of the marine vessel 20 relative to the global position of a known obstruction, such as a bridge. As mentioned above, the GPS receiver 116 detects a current global position of the marine vessel 20. In non-limiting examples, the memory of the storage system 106 stores one or more waypoints that are known to be associated with an obstruction that might be impacted by the marine vessel 20 and more particularly the bimini top 22 in a raised position, but which the marine vessel 20 with the bimini top 22 in a lowered position would freely pass. In this example, when the global position of the marine vessel 20 compares to one of the stored waypoints, the controller 102 is configured to take corrective action such as alerting the operator of the system 100 and/or automatically controlling the lower actuator 54 to lower the cover 41 of the bimini top 22, as further described herein below.

It should also be recognized that when the system 100 determines the absence of an obstruction, such as in the example described herein above with reference to FIG. 9, the system 100 optionally can be configured to automatically take action, such as alerting the operator of the system 100 and/or automatically controlling the lower actuator 54 to raise the cover 41 of the bimini top 22.

It will thus be understood from the foregoing description that by configuring the system 100 with combinations of the features described herein above with reference to FIGS. 8-14, the present disclosure provides a significantly improved systems which are able to automatically identify an obstruction (e.g. a bridge deck or any other obstruction) within a zone of travel 214 for the marine vessel 20, including advantageously automatically delineating a zone of travel 214 for identifying the obstruction in such a way that accounts for the angle of inclination of the marine vessel 20 and/or differences between heading and direction of travel of the marine vessel 20. Based on an identified obstruction, the present disclosure provides improved systems for taking corrective action, as further described herein below, so as to avoid damage to the marine vessel 20, the bimini top 22, or the obstruction. The present disclosure further provides significantly improved systems which are configured to automatically lower the bimini top 22 based upon the global position of the marine vessel 20 relative to a waypoint associated with a known obstruction. The present disclosure further provides significantly improved systems with are configured to automatically raise the bimini top 22 based upon the absence of an obstruction. The methods by which the above advantages are accomplished may vary and non-limiting examples thereof are described herein below with reference to FIGS. 15-19.

Figure 15:
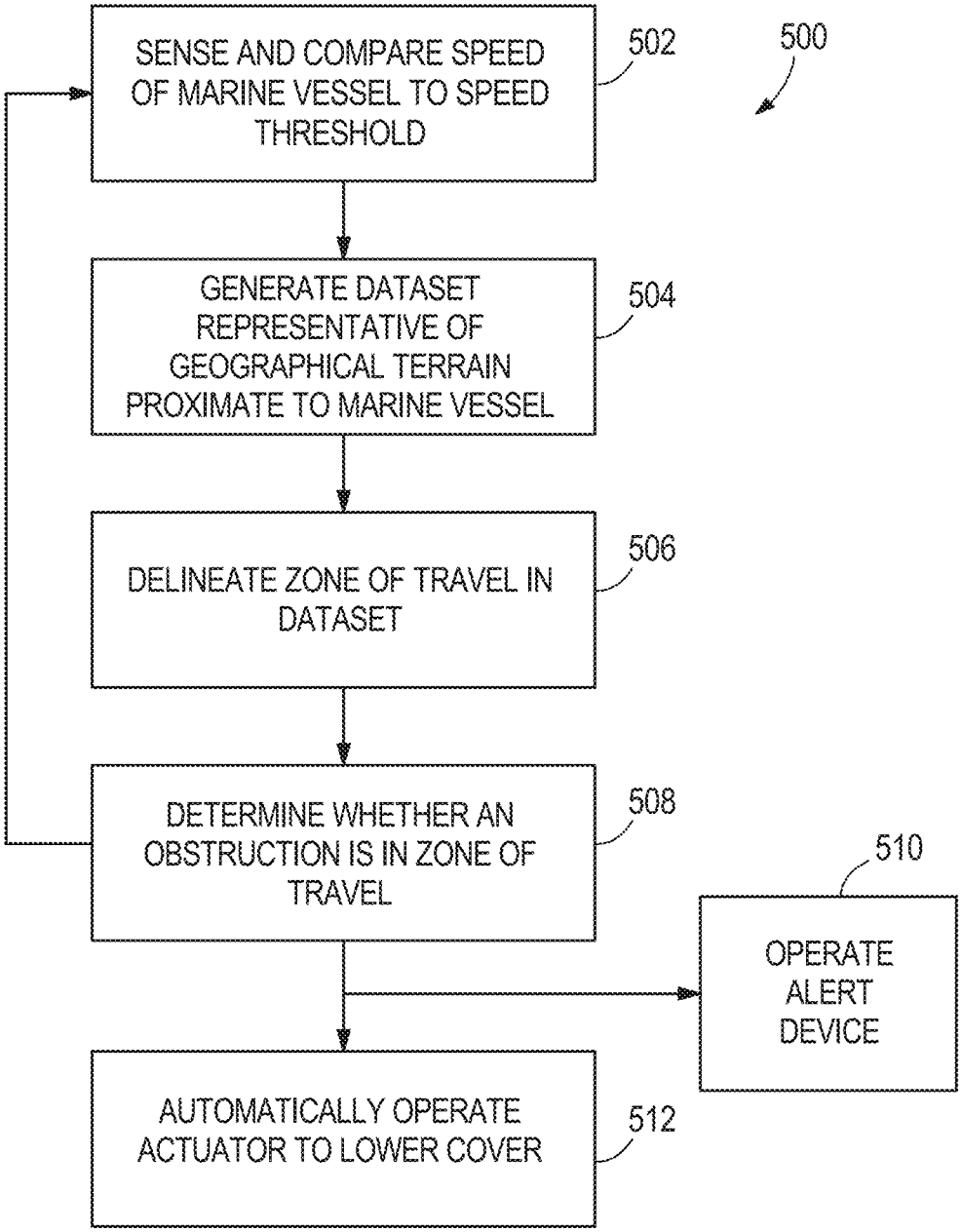

FIG. 15 depicts a first non-limiting example of a method 500 according to the present disclosure. At step 502, the speed sensor 118 detects the current speed of the marine vessel 20 and communicates the current speed to the controller 102. The controller 102 compares the current speed to a threshold speed stored in the memory of the storage system 106. Based on the comparison, the controller 102 either continues to carry out the rest of the steps shown in FIG. 15 or repeats step 502. For example if the current speed exceeds the threshold speed, the controller 102 proceeds to step 504, If the current speed does not exceed the threshold speed, the controller 102 repeats step 502.

At step 504, the proximity sensor 112 senses the geographical terrain proximate to the marine vessel 20 and generates a dataset 200 representative of the geographical terrain. At step 506, the controller 102 is programmed to delineate a zone of travel 214 in the dataset 200. At step 508, the controller 102 is programmed to determine whether an obstruction is present in the zone of travel 214. If no, the method repeats step 502. If yes, the controller 102 takes corrective action, such as shown in steps 510 and/or 512, as described herein below.

At step 510, the controller 102 controls the alert device 122 to alert the operator of the marine vessel 20 or an occupant of the marine vessel 20 that the marine vessel 20 is approaching an obstacle that may be impacted by the marine vessel 20, including the bimini top 22. At step 512, the controller 102 automatically operates the lower actuator 54 to lower the bimini top 22, which brings the cover frame 40 and cover 41 closer to the deck 38 so as to reduce the height of the marine vessel 20 relative to the body of water 206 below the height of the obstruction. Optionally, subsequently the controller 102 can be further configured to operate the alert device 122 and/or operate the lower actuator 54 to raise the bimini top 22 once the obstruction is no longer in the zone of travel 214.

Figure 16:
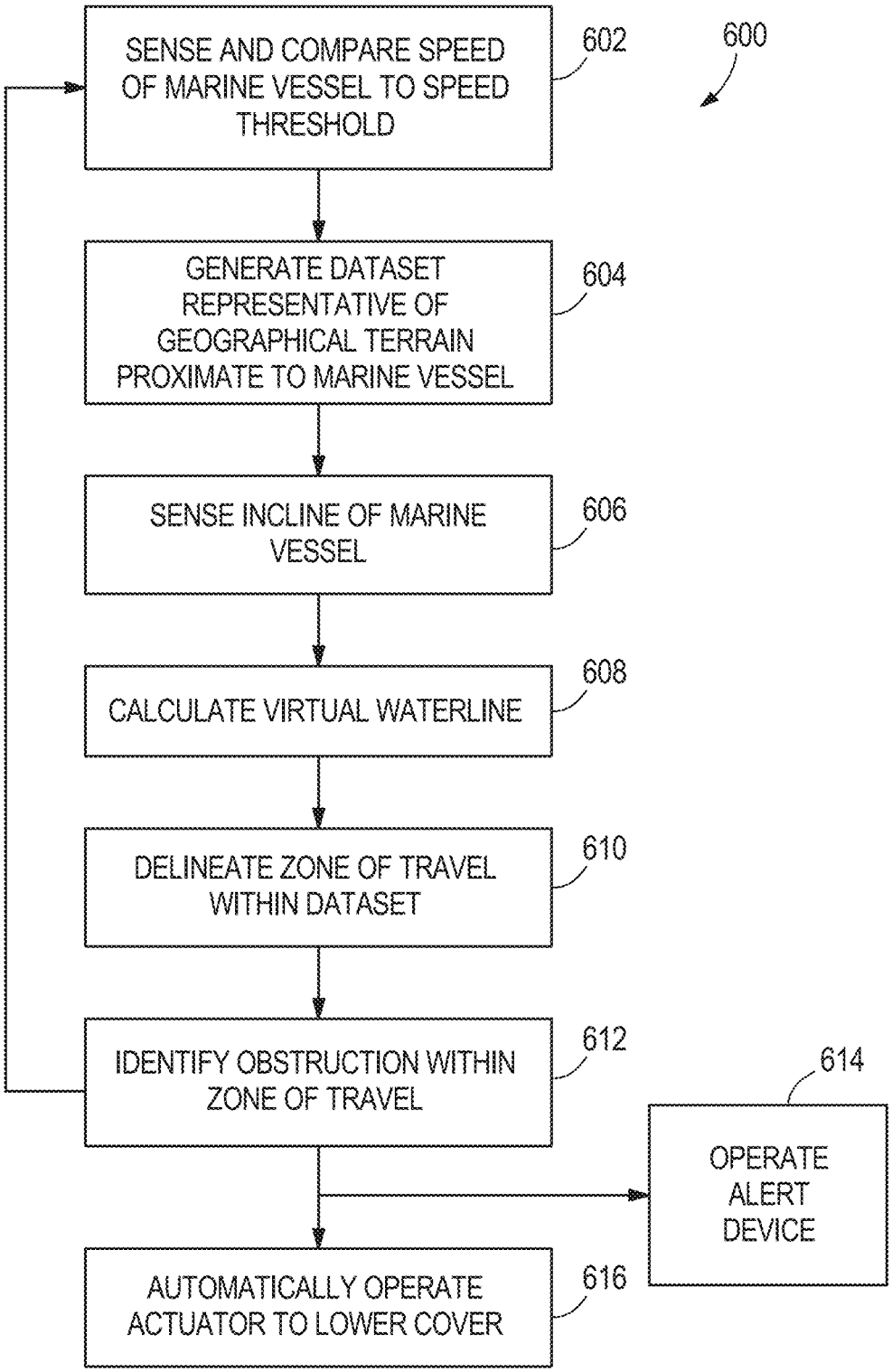

FIG. 16 depicts a second non-limiting example of a method 600 according to the present disclosure. At step 602, the speed sensor 118 detects the current speed of the marine vessel 20 and communicates the current speed to the controller 102. The controller 102 compares the current speed to a threshold speed stored in the memory of the storage system 106. Based on the comparison, the controller 102 either continues to carry out the rest of the steps shown in FIG. 16 or repeats step 602. For example if the current speed exceeds the threshold speed, the controller 102 proceeds to step 604, If the current speed does not exceed the threshold speed, the controller 102 repeats step 602.

At step 604, the proximity sensor 112 senses the geographical terrain proximate to the marine vessel 20 and generates a dataset 200 representative of the geographical terrain. At step 606, the inclinometer 114 determines the angle of inclination a of the marine vessel 20. At step 608, the controller 102 determines the virtual waterline based upon the angle of inclination a and the stored virtual waterline, which corresponds to the expected waterline 204 on the marine vessel 20 in a calm body of water 206. At step 610, the controller 102 is programmed to delineate the zone of travel 214 based upon the newly calculated virtual waterline, in particular by locating the lower threshold of the height range 216 of the zone of travel 214 at the newly calculated virtual waterline.

At step 612, the controller 102 is programmed to determine whether an obstruction is present in the zone of travel 214. If no, the method repeats step 602. If yes, the controller 102 takes corrective action, such as shown in steps 612 and/or 614. At step 614, the controller 102 controls the alert device 122 to alert the operator of the marine vessel 20 or an occupant of the marine vessel 20 that the marine vessel 20 is approaching an obstacle that may be impacted by the marine vessel 20, including the bimini top 22. At step 616, the controller 102 automatically operates the lower actuator 54 to lower the bimini top 22, which brings the cover frame 40 and cover 41 closer to the deck 38 so as to reduce the height of the marine vessel 20 relative to the body of water 206 below the height of the obstruction. Optionally, subsequently the controller 102 can be further configured to operate the alert device 122 and/or operate the lower actuator 54 to raise the bimini top 22 once the obstruction is no longer in the zone of travel 214.

Figure 17:
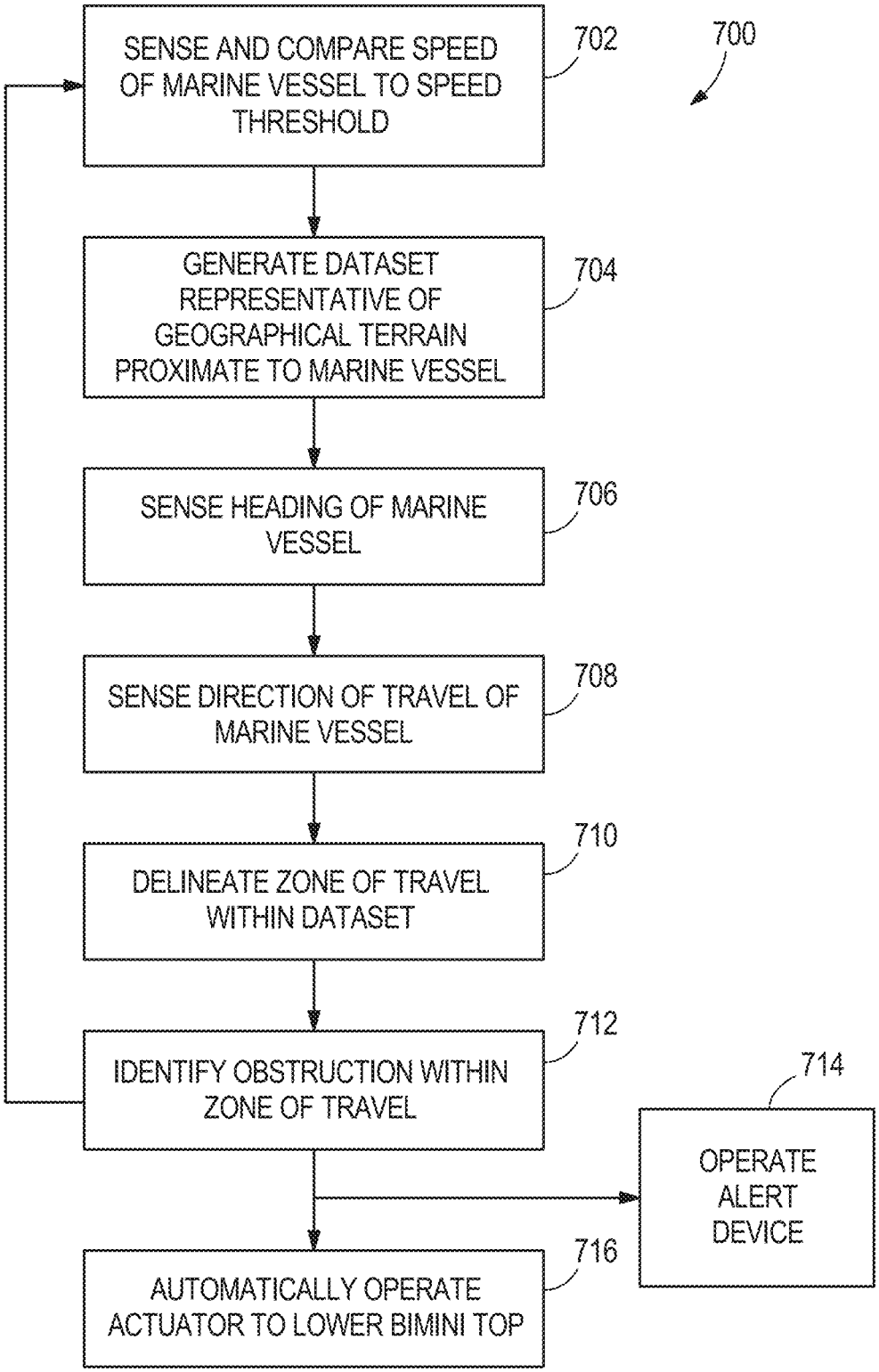

FIG. 17 depicts a third non-limiting example of a method 700 according to the present disclosure. At step 702, the speed sensor 118 detects the current speed of the marine vessel 20 and communicates the current speed to the controller 102. The controller 102 compares the current speed to a threshold speed stored in the memory of the storage system 106. Based on the comparison, the controller 102 either continues to carry out the rest of the steps shown in FIG. 17 or repeats step 702. For example if the current speed exceeds the threshold speed, the controller 102 proceeds to step 704, If the current speed does not exceed the threshold speed, the controller 102 repeats step 702.

At step 704, the proximity sensor 112 senses the geographical terrain proximate to the marine vessel 20 and generates a dataset 200 representative of the geographical terrain. At step 706, the heading detector determines the heading of the marine vessel 20. At step 708, GPS receiver 116 determines the direction of travel of the marine vessel 20. At step 710, the controller 102 is programmed to delineate the zone of travel 214 based upon direction of travel of the marine vessel 20, in particular by locating the lateral mid-point of the zone of travel 214 on the direction of travel detected by the GPS receiver 116.

At step 712, the controller 102 is programmed to determine whether an obstruction is present in the zone of travel 214. If no, the method repeats step 702. If yes, the controller 102 takes corrective action, such as shown in steps 714 and/or 716. At step 714, the controller 102 controls the alert device 122 to alert the operator of the marine vessel 20 or an occupant of the marine vessel 20 that the marine vessel 20 is approaching an obstacle that may be impacted by the marine vessel 20, including the bimini top 22. At step 716, the controller 102 automatically operates the lower actuator 54 to lower the bimini top 22, which brings the cover frame 40 and cover 41 closer to the deck 38 so as to reduce the height of the marine vessel 20 relative to the body of water 206 below the height of the obstruction. Optionally, subsequently the controller 102 can be further configured to operate the alert device 222 and/or operate the lower actuator 54 to raise the bimini top 22 once the obstruction is no longer in the zone of travel 214.

Figure 18:
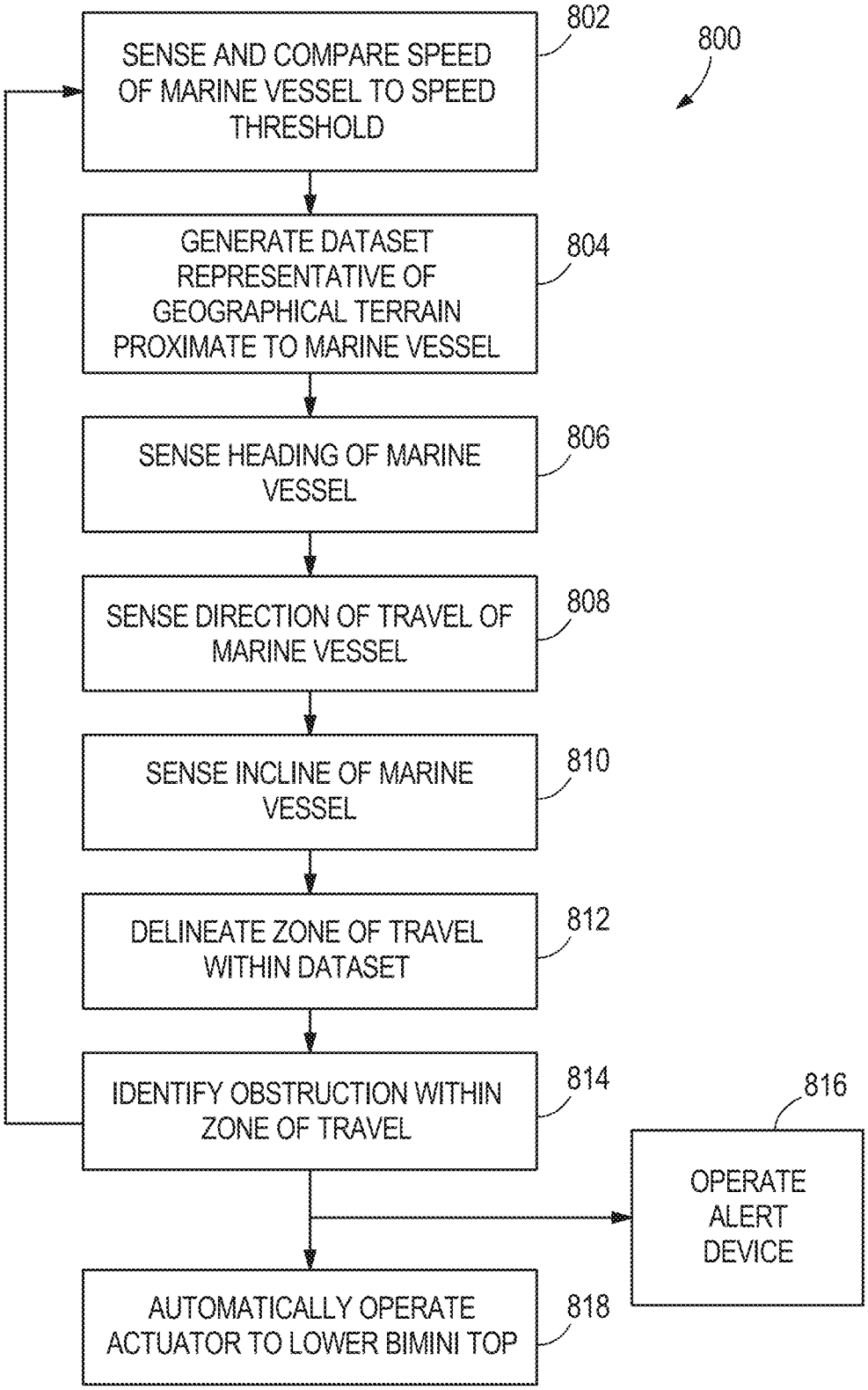

FIG. 18 depicts a fourth non-limiting example of a method 800 according to the present disclosure. At step 802, the speed sensor 118 detects the current speed of the marine vessel 20 and communicates the current speed to the controller 102. The controller 102 compares the current speed to a threshold speed stored in the memory of the storage system 106. Based on the comparison, the controller 102 either continues to carry out the rest of the steps shown in FIG. 18 or repeats step 802. For example if the current speed exceeds the threshold speed, the controller 102 proceeds to step 804, If the current speed does not exceed the threshold speed, the controller 102 repeats step 802.

At step 804, the proximity sensor 112 senses the geographical terrain proximate to the marine vessel 20 and generates a dataset 200 representative of the geographical terrain. At step 806, the heading detector determines the heading of the marine vessel 20. At step 808, GPS receiver 116 determines the direction of travel of the marine vessel 20. At step 810, the inclinometer 114 determines the angle of inclination a of the marine vessel 20.

At step 812, the controller 102 is programmed to delineate the zone of travel 214 in the dataset 200 based upon the direction of travel of the marine vessel 20, in particular by locating the lateral mid-point of the zone of travel 214 on the direction of travel detected by the GPS receiver 116. The controller 102 is further programmed to delineate the zone of travel 214 in the dataset 200 based upon the angle of inclination a of the marine vessel 20, in particular by calculating the virtual waterline and locating the lower threshold of zone of travel 214 on the virtual waterline.

At step 814, the controller 102 is programmed to determine whether an obstruction is present in the zone of travel 214. If no, the method repeats step 802. If yes, the controller 102 takes corrective action, such as shown in steps 816 and/or 818. At step 816, the controller 102 controls the alert device 122 to alert the operator of the marine vessel 20 or an occupant of the marine vessel 20 that the marine vessel 20 is approaching an obstacle that may be impacted by the marine vessel 20, including the bimini top 22. At step 818, the controller 102 automatically operates the lower actuator 54 to lower the bimini top 22, which brings the cover frame 40 and cover 41 closer to the deck 38 so as to reduce the height of the marine vessel 20 relative to the body of water 206 below the height of the obstruction. Optionally, subsequently the controller 102 can be further configured to operate the alert device 222 and/or operate the lower actuator 54 to raise the bimini top 22 once the obstruction is no longer in the zone of travel 214.

Figure 19:
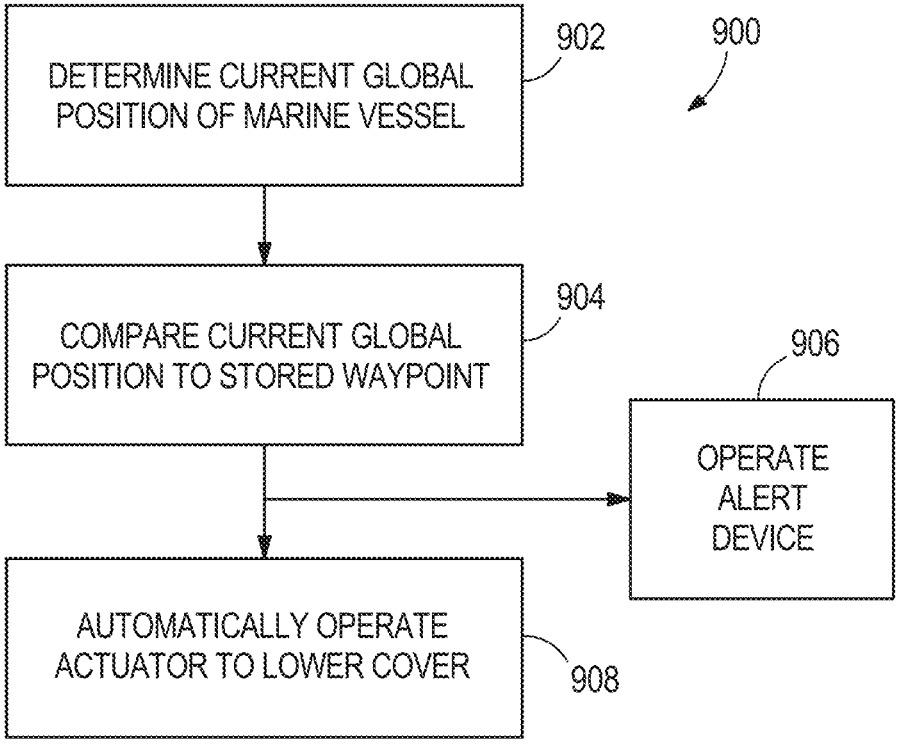

FIG. 19 depicts a fifth non-limiting example of a method 900 according to the present disclosure. At step 902, the GPS receiver 116 determines a current global position of the marine vessel 20. At step 904, the controller 102 is configured to compare the current global position to a stored waypoint which is associated with an obstruction which could be impacted by the marine vessel 20, including the bimini top 22. Based on the comparison, the controller 102 either continues to carry out the rest of the steps shown in FIG. 19 or repeats step 902. For example if the current global position is proximate to the waypoint the method proceeds to steps 906 and/or 908, If the current global position is not proximate to the waypoint, the method repeats step 902. At steps 906 and/or 908 the controller 102 takes corrective action. At step 906, the controller 102 controls the alert device 122 to alert the operator of the marine vessel 20 or an occupant of the marine vessel 20 that the marine vessel 20 is approaching an obstacle that may be impacted by the marine vessel 20, including the bimini top 22. At step 908, the controller 102 automatically operates the lower actuator 54 to lower the bimini top 22, which brings the cover frame 40 and cover 41 closer to the deck 38 so as to reduce the height of the marine vessel 20 relative to the body of water 206 below the height of the obstruction. Optionally, subsequently the controller 102 can be further configured to operate the alert device 222 and/or operate the lower actuator 54 to raise the bimini top 22 once the current global position is not proximate to the waypoint.

This written description uses embodiments to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other embodiments which occur to those skilled in the art. Such other embodiments are intended to be within the scope of the claims if they have features or structural elements which do not differ from the literal language of the claims, or if they include equivalent features or structural elements with insubstantial differences from the literal languages of the claims.

What is claimed is:

1. A convertible bimini top system for a marine vessel having a deck, the convertible bimini top system comprising:

a bimini top having a cover configured to extend over the deck, an actuator configured to raise and lower the cover relative to the deck, a controller configured to operate the actuator, and a sensor configured to sense an obstruction that is proximate to the marine vessel, wherein the controller is configured to automatically operate the actuator to lower the cover when the sensor senses the obstruction, and wherein the sensor is configured to generate a dataset representative of a geographical terrain proximate to the marine vessel, the obstruction being part of the dataset.

2. The convertible bimini top system according to claim 1, wherein the controller is configured to delineate a zone of travel for the marine vessel within the dataset, and to determine whether the obstruction is in the zone of travel, and further wherein the controller is configured to automatically operate the actuator to lower the cover only when the obstruction is determined to be in the zone of travel.

3. The convertible bimini top system according to claim 1, wherein the dataset includes point cloud data.

4. The convertible bimini top system according to claim 3, wherein the sensor includes a lidar sensor configured to generate the point cloud data.

5. The convertible bimini top system according to claim 2, wherein the controller includes a memory that stores a height range and a width range for the zone of travel.

6. The convertible bimini top system according to claim 5, wherein the controller determines that the obstruction is in the zone of travel when the obstruction is in the height range and in the width range.

7. The convertible bimini top system according to claim 5, further comprising an inclinometer communicatively connected to the controller, the inclinometer being configured to determine an angle of inclination of the marine vessel, wherein the controller is configured to calculate a virtual waterline of a body of water in which the marine vessel is situated based on the angle of inclination.

8. The convertible bimini top system according to claim 7, wherein the height range has a lower threshold and an upper threshold, and wherein the controller is configured to set the lower threshold at the virtual waterline.

9. The convertible bimini top system according to claim 5, further comprising a heading detector configured to determine a heading of the marine vessel, and wherein the width range laterally extends between a port threshold and a starboard threshold, wherein the width range has a lateral mid-point located midway between the port threshold and starboard threshold, and wherein the controller is configured to set the lateral mid-point on the heading of the marine vessel.

10. The convertible bimini top system according to claim 9, further comprising a global positioning system (GPS) receiver configured to determine a current direction of travel of the marine vessel, wherein the controller is configured to adjust the lateral mid-point based upon a difference between the heading and the current direction of travel.

11. A convertible bimini top system for a marine vessel having a deck, the convertible bimini top system comprising:

a bimini top having a cover configured to extend over the deck, an actuator configured to raise and lower the cover relative to the deck, a controller configured to operate the actuator, a sensor configured to sense an obstruction that is proximate to the marine vessel, wherein the controller is configured to automatically operate the actuator to lower the cover when the sensor senses the obstruction, a memory that stores a speed threshold, and a speed sensor configured to sense a current speed of the marine vessel, wherein the controller is configured to automatically operate the actuator to lower the cover when the sensor senses the obstruction and by comparing the current speed to the speed threshold.

12. A convertible bimini top system for a marine vessel having a deck, the convertible bimini top system comprising:

a bimini top having a cover configured to extend over the deck, an actuator configured to raise and lower the cover relative to the deck, a controller configured to operate the actuator, a sensor configured to sense an obstruction that is proximate to the marine vessel, and a global positioning system (GPS) receiver configured to determine a current global position of the marine vessel, wherein the controller is configured to operate the actuator to lower the cover when the sensor senses the obstruction and based on the current global position.

13. The convertible bimini top system according to claim 12, wherein the controller includes a memory that stores a waypoint associated with the obstruction, and wherein the controller is configured to automatically operate the actuator to lower the cover based on a comparison of the current global position to the waypoint.

14. The convertible bimini top system according to claim 1, wherein the controller is configured to automatically operate the actuator to raise the cover based on an absence of the obstruction proximate the marine vessel.

15. A convertible bimini top system for a marine vessel having a deck, the convertible bimini top system comprising:

a bimini top having a cover configured to extend over the deck, an actuator configured to raise and lower the cover relative to the deck, a controller configured to operate the actuator, and a sensor configured to sense an obstruction that is proximate to the marine vessel, wherein the controller is configured to automatically operate the actuator to lower the cover when the sensor senses the obstruction, and wherein the sensor includes a stereo-optic camera configured to generate a disparity map.

16. A method of controlling a convertible bimini top having a cover extending over a deck of a marine vessel, the method comprising operating a sensor to identify an existence of an obstruction that is proximate to the marine vessel, and automatically operating an actuator to lower the cover relative to the deck based on the existence of the obstruction, and operating the sensor to generate a dataset that is representative of geographical terrain proximate to the marine vessel, delineating a zone of travel for the marine vessel within the dataset, and automatically operating the actuator to lower the cover only when the obstruction is determined to be within the zone of travel.

17. The method according to claim 16, wherein the zone of travel has a height range and a width range and further comprising determining that the obstruction is within the zone of travel when the obstruction is in the height range and in the width range.

18. The method according to claim 17, further comprising determining a virtual waterline for a body of water in which the marine vessel is situated and adjusting a location of the height range in the dataset based on the virtual waterline.

19. The method according to claim 17, further comprising adjusting a location of the width range in the dataset based on a heading of the marine vessel and a current direction of travel of the marine vessel.

20. A method of controlling a convertible bimini top having a cover extending over a deck of a marine vessel, the method comprising:

operating a sensor to identify an existence of an obstruction that is proximate to the marine vessel, and automatically operating an actuator to lower the cover relative to the deck based on the existence of the obstruction, and determining a current global position of the marine vessel and automatically operating the actuator to lower bimini top based on a comparison of the current global position to a stored waypoint associated with the obstruction.

21. The method according to claim 16, further comprising automatically operating the actuator to raise the convertible bimini top based on an absence of the obstruction.

* * * * *